United States Patent [19]

Hashimoto et al.

[11] Patent Number: 4,848,301

[45] Date of Patent: Jul. 18, 1989

[54] FUEL FEED QUANTITY CONTROL SYSTEM FOR INTERNAL COMBUSTION ENGINE

[75] Inventors: Toru Hashimoto; Akira Takahashi, both of Kyoto; Mamoru Sugiura, Kameoka; Hiroshi Takamatsu, Kyoto; Takeshi Jinbo; Yasuhiko Saito, both of Okazaki; Yoshiaki Kanno, Himeji, all of Japan

[73] Assignees: Mitsubishi Jidosha Kogyo Kabushiki Kaisha; Mitsubishi Denki Kabushiki Kaisha, both of Tokyo, Japan

[21] Appl. No.: 157,358

[22] Filed: Feb. 18, 1988

[30] Foreign Application Priority Data

Feb. 18, 1987 [JP] Japan ..... 62-35179
Apr. 13, 1987 [JP] Japan ..... 62-91214
Apr. 14, 1987 [JP] Japan ..... 62-92721

[51] Int. Cl.[4] ..... F02D 41/18; F02M 51/00

[52] U.S. Cl. ..... 123/494; 123/486; 123/488; 73/861.02; 364/510

[58] Field of Search ..... 123/478, 480, 486, 488, 123/494; 73/118.2, 861.02, 861.03; 364/510, 558

[56] References Cited

U.S. PATENT DOCUMENTS 4,455,985 6/1984 Asayama ..... 123/494
4,457,281 7/1984 Ueyama et al. ..... 123/494 X
4,606,318 8/1986 Tsuchida et al. ..... 73/861.02 X
4,633,838 1/1987 Fukui ..... 123/488
4,683,858 8/1987 Sato et al. ..... 123/486
4,694,806 9/1987 Wataya et al. ..... 123/494

FOREIGN PATENT DOCUMENTS 3624351 1/1987 Fed. Rep. of Germany .

*Primary Examiner*—Willis R. Wolfe

[57] ABSTRACT

A fuel feed quantity control system of the so-called L-Jetronic system is described. The system is equipped with a Karman vortex air-flow sensor, at least one injector for feeding a fuel into an internal combustion engine, a controller for controlling the quantity of the fuel, which is to be injected, on the basis of intake air flow rate information from the air-flow sensor, and at least one operation parameter sensor. The controller also includes at least one additional control unit which serves to correct the quantity of the fuel, which is to be fed into the engine, in accordance with at least one operation parameter from the operation parameter sensor and frequency information outputted from the air-flow sensor. The quantity of the fuel, which has been determined based on an output from the air-flow sensor, is corrected by the controller in accordance with changes in kinematic viscosity of the atmospheric air.

8 Claims, 37 Drawing Sheets

FIG. 32
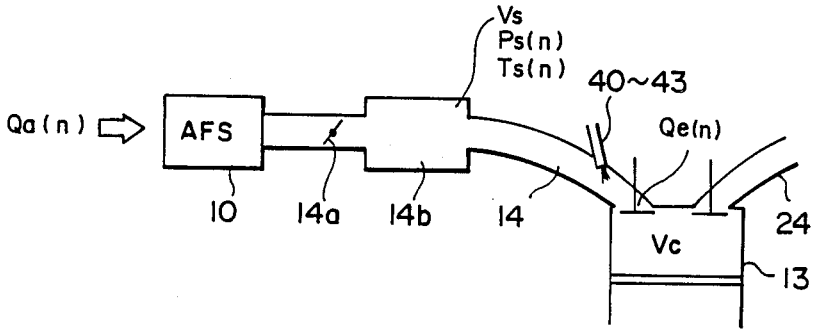
FIG. 33(a)
FIG. 33(b)
FIG. 33(c)
FIG. 33(d)
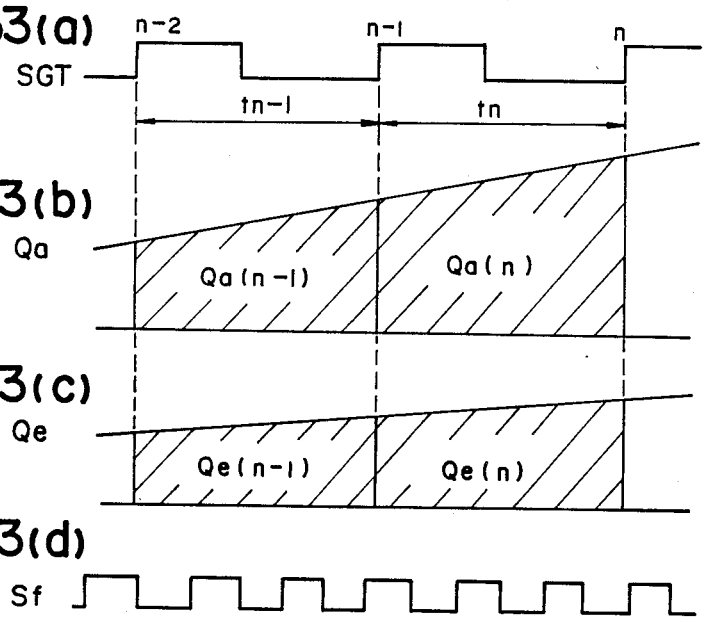

OUTPUT OF FREQUENCY DIVIDER 231

OUTPUT OF CRANK ANGLE SENSOR 27

PD
156
0

PR
0
t1
t2
t3
t4
t5
t6
t7
t8
t9
t10
t11
t12
t13
t14
t15
t16
TA
TS
TR
PDi
PDi
156

FUEL FEED QUANTITY CONTROL SYSTEM FOR INTERNAL COMBUSTION ENGINE

BACKGROUND OF THE INVENTION (1) Field of the Invention

This invention relates to a fuel feed quantity control system for an internal combustion engine (hereinafter called "engine"), and particularly to a fuel feed quantity control system of the so-called L Jetronic system, which performs the control of fuel feed quantity by directly detecting the intake flow rate of the engine.

(2) Description of the Related Art

As conventional fuel feed quantity systems of such L Jetronic system, there are systems adapted to control the fuel feed quantity on the basis of intake flow rate information from an air-flow sensor of the Karman vortex detection type arranged in an intake passage of an engine.

The air-flow sensor of the Karman vortex detection type is arranged in the intake passage of the engine. As depicted in FIG. 40, the air-flow sensor 10 is composed of a flow straightener 1, a passage 2 with a sound absorbing material applied on the inner wall of the passage, a vortex generator (Brough body) 3, vortex-stabilizing plates 4, ultrasonic wave transmitter 5, ultrasonic wave receiver 6, and an electronic circuit (see FIG. 41).

Owing to the provision of the air-flow sensor, the inducted air is straightened by the flow straightener 1 and then flows through the passage 2, whereby a train of vortices is created by the vortex generator 3. The frequency of generation of these Karman vortices is proportional to the flow velocity of the inducted air. An ultrasonic wave of about 40 KHz, which has been transmitted from the ultrasonic wave transmitter 5 toward the ultrasonic wave receiver 6, is affected by the Doppler effect of the revolutionary flow of each Karman vortex, so that the propagation time from the ultrasonic wave transmitter 5 to the ultrasonic wave receiver 6 changes. Namely, this propagation time varies in accordance with a change in the frequency of generation of Karman vortices, which change in turn takes place due to a change in the flow velocity of the inducted air. Accordingly, the ultrasonic wave from the ultrasonic wave transmitter 5 is subjected to phase modulation by the flow velocity of the inducted air (namely, the flow rate of the inducted air) and is then received by the ultrasonic wave receiver 6.

In the electronic circuit, as illustrated in FIG. 41, an oscillator 7 delivers a pulse signal to the ultrasonic wave transmitter 5 so as to transmit the ultrasonic wave. At the same time, the oscillator 7 also outputs as a reference signal the same pulse signal as the aforementioned pulse signal to a phase comparator 9 via an average phase follow-up circuit (phase-shift circuit or subtractor) 8, and a signal outputted from the ultrasonic wave receiver 6 is delivered via an amplifier 12 to a phase comparator 9 where the output signal of the receiver is compared with the reference signal, whereby the output signal of the receiver is demodulated in phase and is thereafter outputted.

Since the above-described propagation time varies slightly depending on the temperature of the inducted air, a low frequency fraction (a fraction of frequencies lower than the frequency of generation of Karman vortices) caused due to variations of the intake air temperature is detected from signals outputted from the phase comparator 9 by means of a low-pass filter (loop filter) 11. By a detection signal thus generated, the average phase follow-up circuit 8 shifts the phase of the pulse signal from the ultrasonic transmitter 6 thereby to compensate the modulation by the intake air temperature.

Such control systems may be classified into the synchronous system, in which the state of operation of an engine is controlled in unison with the signal outputted from an air-flow sensor, and other systems.

Incidentally, the output frequency of the air-flow sensor (the frequency of generation of Karman vortices) f is expressed by the following equation:

$$f = Sr(u/d) \quad (1)$$

where u: flow velocity, d: width of vortex generator and Sr Strouhal number. The Strouhal number Sr is in turn expressed as a function of the Reynolds number Re of a flow around the vortex generator 3 (FIG. 42). By the way, the Reynolds number Re is expressed by the following equation:

$$Re = u(d/\nu) \quad (2)$$

where $\nu$: kinematic viscosity of air.

When the intake air temperature $T_a$ or intake air density (atmospheric pressure) $P_a$ varies, the kinematic viscosity $\nu$ of air changes as shown in FIG. 43 and accordingly, the Strouhal number St also changes so that the output frequency f of the air-flow sensor is altered. In FIG. 43, numbers shown in parentheses in FIG. 43 correspond to an atmospheric pressure of 75 mmHg while those indicated without parentheses correspond to an atmospheric pressure of 750 mmHg.

Further, the relationship between the output frequency f of the air-flow sensor and the flow rate (pulse constant) $P_c$ per pulse outputted from the air-flow sensor also varies with the intake air temperature or the atmospheric pressure. The manner of changes of the Pc-f characteristics for the intake temperature as a parameter may be illustrated as shown in FIG. 44.

It is appreciated that such a phenomenon becomes remarkable where the Reynolds number Re is small (i.e., smaller than $10^3$), as is apparent from FIG. 42 too.

Let's now consider the current correction of the air/fuel ratio. It is practised to correct the air density by the output of the air-flow sensor (the quantity of air inducted) on the basis of the intake air temperature or the air density which changes with the atmospheric air. However, no correction has been performed at all taking into consideration the fact that the output frequency of the air-flow sensor itself varies in accordance with changes in the kinematic viscosity $\nu$.

Accordingly, let's assume that the intake temperature has increased. Since the kinematic viscosity $\nu$ increases and the Reynolds number Re and Strouhal number Sr decreases, the output frequency of the air-flow sensor drops even when the flow velocity u is constant. This has led to a problem that the air/fuel ratio becomes leaner correspondingly.

SUMMARY OF THE INVENTION

With a view toward providing a solution to such problems, it is an object of this invention to provide a fuel feed quantity control system for an engine so that the fuel feed quantity control which is performed depending on the output frequency of an air-flow sensor may be corrected in accordance with changes of the kinematic viscosity of air.

In one aspect of this invention, there is thus provided a fuel feed quantity control system for an internal combustion engine, which comprises:

a Karman vortex air-flow sensor arranged in an intake passage of the engine;

at least one injector for feeding a fuel into the engine;

a means for controlling the quantity of the fuel, which is to be injected from the injector, on the basis of intake air flow rate information from the air-flow sensor;

a means for detecting at least one operation parameter of the engine; and a means for correcting the quantity of the fuel, which is to be fed into the engine, in accordance with said at least one operation parameter from said operation parameter detecting means and frequency information outputted from the air-flow sensor;

whereby the quantity of the fuel, which has been determined based on an output from the air-flow sensor, is corrected by the fuel feed quantity correcting means in accordance with a change in kinematic viscosity of the atmospheric air.

According to the fuel feed quantity control system of this invention for the engine, the fuel quantity control means is provided with the fuel feed quantity correcting means which is adapted to correct the quantity of the fuel to be fed (which may hereinafter be referred to as "fuel feed quantity") in accordance with the information on the operation parameter and the information on the output frequency of the air-flow sensor, so that the output of the air-flow sensor is corrected in accordance with variations in kinematic viscosity of the atmospheric air, in other words, the correction of the feed fuel quantity control can be performed in accordance with the so-called L-Jetronic system, thereby bringing about a merit that the fuel feed quantity control can be effected with high accuracy and high reliability.

BRIEF DESCRIPTION OF THE DRAWINGS

FIGS. 1–10 show a fuel feed quantity control system according to a first embodiment of this invention, which is suitable for use with an engine, in which:

FIG. 1 is an electric circuit diagram illustrating the overall construction of the system, FIG. 2 is a simplified block diagram of an engine system equipped with the system, FIG. 3 is an electric circuit diagram which shows a circuit for correcting frequencies outputted from an air-flow sensor of the system, FIG. 4 is a block diagram of the fuel control by the system, FIG. 5 is a flow chart to be referred to upon description of a main routine for the fuel control, FIG. 6 is a flow chart to be referred to upon description of a Karman interruption routine for the fuel control, FIG. 7 is a flow chart to be referred to upon flow description of a crank phase interruption routine for the fuel control, and FIGS. 8–10 are graphic representations which will all be referred to upon illustration of the manner of the frequency correction;

FIGS. 11–18 depict a fuel feed quantity control system according to a second embodiment of this invention, which is suitable for use with an engine, in which:

FIG. 11 is a block diagram of the fuel control by the system,

FIG. 12 is an electric circuit diagram illustrating the overall construction of the system, FIG. 13 is a flow chart to be referred to upon description of a main routine for the fuel control, FIG. 14 is a flow chart to be referred to upon description of a Karman interruption routine for the fuel control, FIG. 15 is a flow chart to be referred to upon description of a crank phase interruption routine for the fuel control, and FIGS. 16–18 are graphic representations which will all be referred to upon illustration of the manner of the frequency correction;

FIGS. 19–25 illustrate a fuel feed quantity control system according to a third embodiment of this invention, which is suitable for use with an engine, in which:

FIG. 19 is a block diagram of the fuel control by the system,

FIG. 20 is a flow chart to be referred to upon description of a main routine for the fuel control, FIG. 21 is a flow chart to be referred to upon description of a Karman interruption routine for the fuel control, FIG. 22 is a flow chart to be referred to upon description of a crank phase interruption routine for the fuel control, and FIGS. 23–25 are graphic representations which will all be referred to upon illustration of the characteristics of correction factors for performing the correction of the fuel control;

FIGS. 26–29 shows a fuel feed quantity control system according to a fourth embodiment of this invention, which is suitable for use with an engine, in which:

FIG. 26 is a block diagram of the fuel control by the system,

FIG. 27 is a flow chart to be referred to upon description of a main routine for the fuel control, FIG. 28 is a flow chart to be referred to upon description of a Karman interruption routine for the fuel control, and FIG. 29 is a flow chart to be referred to upon description of a crank phase interruption routine for the fuel control;

FIGS. 30–38 illustrates a fuel feed quantity control system according to a fifth embodiment of this invention, which is suitable for use with an engine, in which:

FIG. 30 is a simplified block diagram showing the system,

FIG. 31 is a block diagram of an exemplary specific structure of the system, FIG. 32 is a simplified schematic illustration of one example of an intake system to which the system is applied, FIGS. 33(*a*) –(*d*) is a graphic representation showing the quantity of inducted air as a function of the crank angle of the engine, FIGS. 34(*a*)–(*d*) are waveform diagrams showing changes in the quantity of air inducted during a transition period of the engine, FIGS. 35, 36, 37(*a*) and 37(*b*) are flow charts, which show different one of the system respectively, and FIGS. 38(*a*)–(*d*) is a timing chart illustrating the individual flow timings of FIGS. 36, 37(*a*) and 37(*b*);

FIGS. 40 and 41 illustrate a conventional air-flow sensor of the Karman vortex detection type, in which:

FIG. 40 is a schematic illustration of the concept structure of the air-flow sensor, and FIG. 41 is an electric circuit diagram of the air-flow sensor;

DESCRIPTION OF THE PREFERRED EMBODIMENTS

Figure 1:
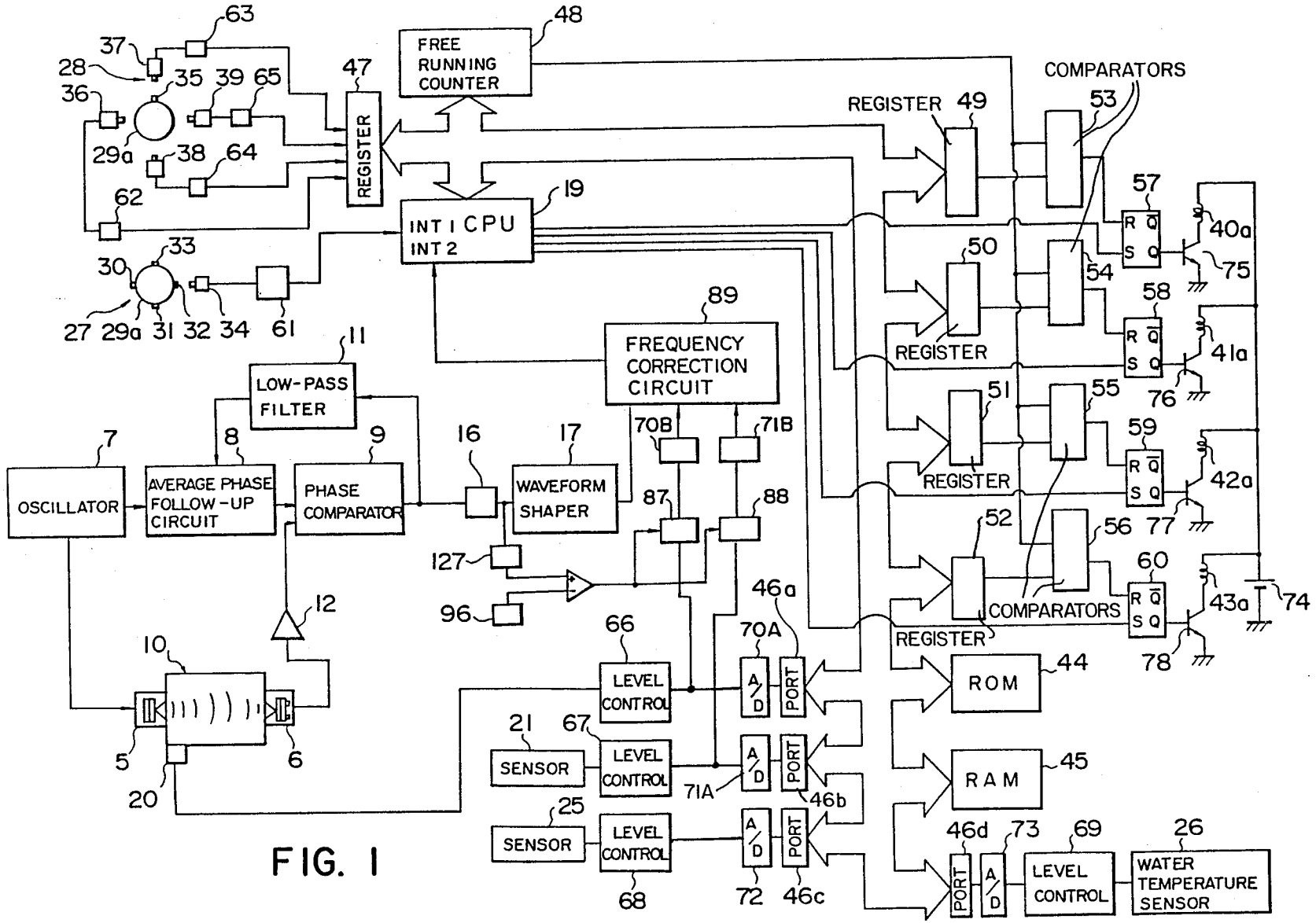
Figure 2:
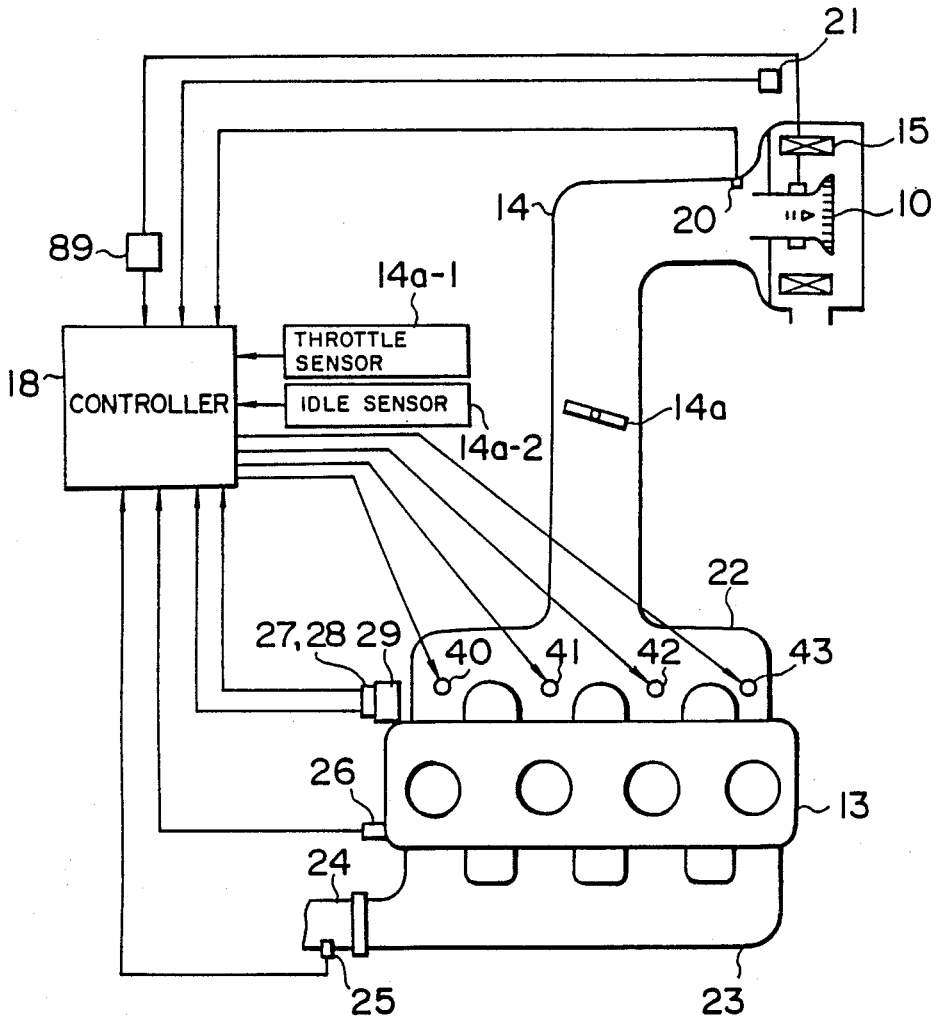
Figure 3:
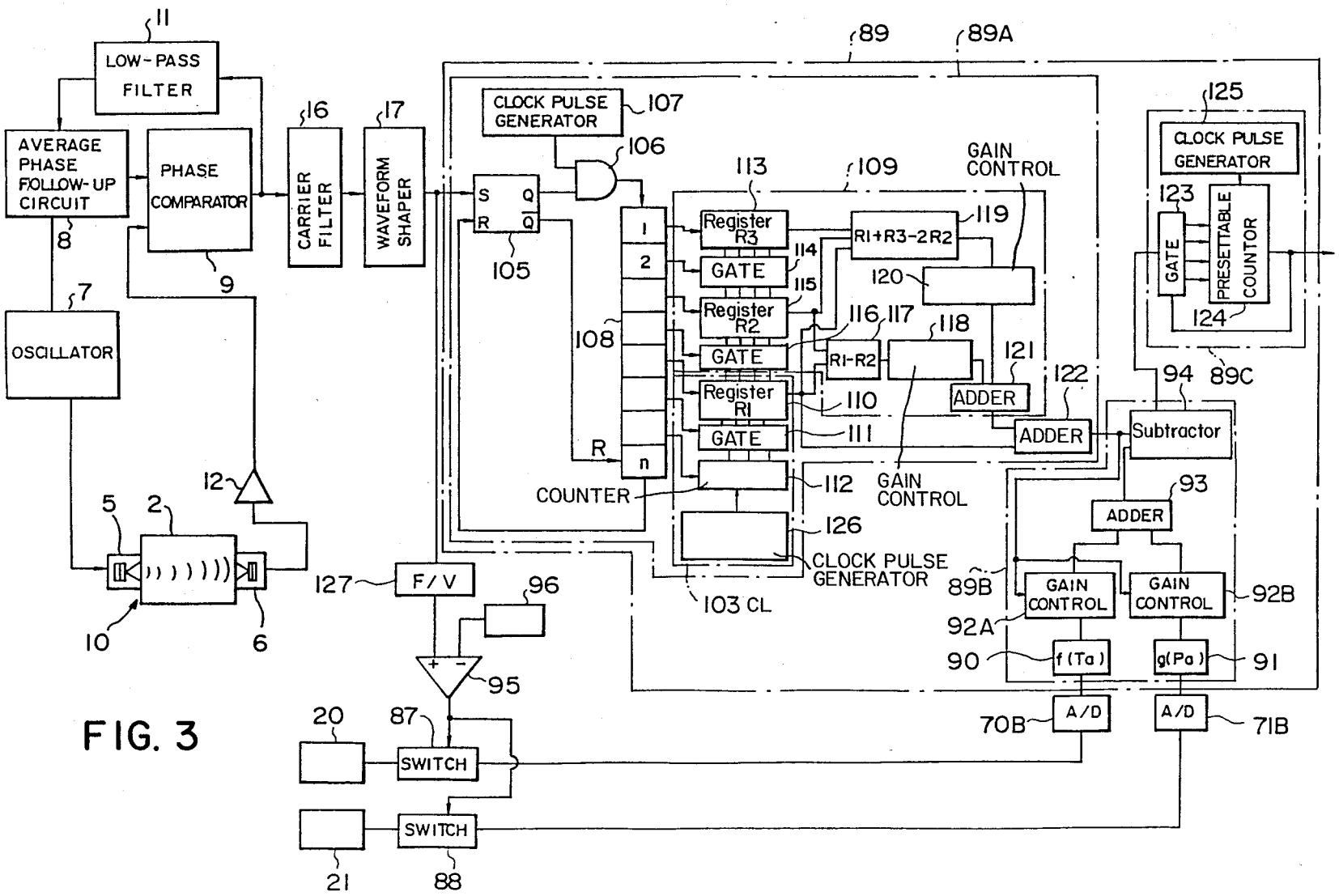

The first to sixth embodiments of the present invention will hereinafter be described with the accompanying drawings. First of all, FIGS. 1–10 illustrate the fuel feed quantity control system according to the first embodiment of this invention, which is suitable for use with the engine. The fuel feed quantity control system of the first embodiment is an L-Jetronic and multi-point injection fuel feed quantity control system. In this embodiment, as illustrated in FIG. 2, the air-flow sensor 10 of the Karman vortex detection type is provided as an element integral with an air cleaner 15 in an intake passage 14 through which inducted air is introduced into each combustion chamber of an in-line 4-cylinder internal combustion engine 13. The air-flow sensor 10 is of the same type as the conventional ones (see FIGS. 30 and 31). As depicted in FIGS. 1 and 3, the air-flow sensor 10 is constructed of the flow straightener 1, the passage 2 with a sound absorbing material applied on the inner wall thereof, the vortex generator (Brough body) 3, vortex-stabilizing plates 4, ultrasonic wave transmitter 5, ultrasonic wave receiver 6, and the electronic circuit (which is equipped with the oscillator 7, average phase follow-up circuit 8, phase comparator 9, low-pass filter 11 and amplifier 12). The output of the air-flow sensor 10 (i.e., the output of the phase comparator 9) is inputted to a terminal INT2 of a central processing unit (CPU) of a controller 18 by way of a carrier filter 16, waveform shaper 17 and frequency correction circuit 89 as shown in FIG. 1.

Here, the carrier filter 16 outputs as a sinusoidal wave the compressional wave from the phase comparator 9, while the waveform shaper 17 is a circuit which shapes the sinusoidal wave from the carrier filter 16 and converts same into a square-wave signal.

The frequency correction circuit 89 is, as depicted in FIG. 3, equipped with a Karman cycle counter 89A, Karman cycle correction circuit 89B and corrected Karman frequency output circuit 89C.

Firstly, the Karman cycle counter 89A includes an R-S flip-flop 105, AND gate 106, program counter 108, cycle output circuit 103, transitional correcting circuit 109 and adder 122.

The R-S flip-flop 105 receives at a terminal (setting terminal) S a signal from the waveform shaper 17 and is connected at a terminal (output terminal) Q to the AND gate 106. The R-S flip-flop 105 outputs a resetting signal to the program counter 108 from an inverse output terminal $\overline{Q}$ and receives at a terminal (resetting terminal) R a resetting signal from the program counter 108. The AND gate 106 receives an output from the R-S flip-flop 105 and a clock pulse (this clock pulse is a high-speed clock pulse) from a clock pulse generator 107 and outputs a signal to the program counter 108. Namely, upon input of a signal to the R-S flip-flop 105 from the waveform shaper 17, a high-level (may hereinafter be abbreviated as "H") output is sent out from the output terminal Q of the R-S flip-flop 105 when the signal inputted is of a high level. Whenever a clock pulse is inputted from the clock pulse generator 107, the AND gate 106 therefore allows the clock pulse to pass therethrough during the H output.

The program counter 108 has n (eight in the illustrated embodiment) output terminals and whenever a clock pulse is inputted from the AND gate 106, an H output is sent out, for example, successively from 1st –nth output ports. When the H output is sent out from the 8th output terminal, the H output is inputted to the resetting terminal of the R-S flip-flop 105 so that the output terminal Q of the R-S flip-flop 105 is reduced to a low level (may hereinafter be abbreviated "L") and the AND gate 106 is closed accordingly. Since the inverse output terminal $\overline{Q}$ of the R-S flip-flop 105 is however rendered H at the same time, the program counter 108 is reset.

The transitional correction circuit 109 is connected to the upper 4 bits (the 1st–4th bits) of individual output terminals of the program counter 108, the cycle output circuit 103 is connected to the next 3 bits (the 5th–7th bits), and the terminal R of the R-S flip-flop 105 is connected to the lowermost bit.

The cycle output circuit 103 is equipped with a register 110, gate 111 and counter 112 which receive output of the 5th–7th bits of the program counter 108 one by one successively as a resetting signal, gate opening signal and resetting signal respectively. First of all, the counter 112 receives clock pulses (which have a frequency a little bit higher than the maximum value of the Karman frequency) and counts same. Upon opening of the gate 111, the count datum of the counter 112 is inputted as a parallel datum to the register 110. The count datum is stored and then outputted.

When it is desired to renew the datum $R_1$ of the register 110 by a new datum, the datum $R_1$ of the register 110 is reset first of all. The gate 111 is then opened, so that a new count datum of the counter 112 is instantaneously stored in the register 110. The register 110 then outputs the new count datum of the counter 112 instead of the previous datum $R_1$ of the register 110. Thereafter, the counter 112 is reset so as to start counting again. The datum $R_1$ of the register 110 is thus renewed at every occurrence of waveform rise in the waveform shaper 17 since the clock of the clock pulse generator 107 is very fast. Accordingly, Karman cycle information is outputted fro the cycle output circuit 103.

On the other hand, the transitional correction circuit 109 is equipped with a register 113, gate 114, register 115 and gate 116 which successively receive, as resetting signals, outputs of the 1st–4th bits of the program counter 108.

The register 115 receives a datum from the register 110 via the gate 116, while the register 113 in turn receives a datum from the register 115 by way of the gate 114. In the illustrated embodiment, the register 113 is reset first of all so that the gate 114 is opened. Here, the datum $R_2$ of the register 115 is hence replaced by the datum $R_3$ of the register 113. The register 115 is then reset to open the gate 116, whereby the datum $R_1$ of the register 110 is replaced by the datum $R_2$. Thereafter, the register 110, gate 111 and counter 112 are reset. Namely, the last two data before the rise in the waveform shaper 17 are stored in the registers 113,115 respectively. Although the data of the registers 113,115 are thus renewed successively at every occurrence of a rise in the waveform shaper 17, the last two data are always maintained. In the illustrated embodiment, the datum $R_3$ of the register 113 is the second last datum and the datum $R_2$ of the register 115 is the last datum. Needless to say, the datum $R_1$ of the register 110 is the present datum.

The transitional correction circuit 109 is provided with a 1st-order differential circuit 117 and a 2nd-order differential circuit 119. The 1st-order differential circuit 117 is constructed as a differential circuit for computing the difference $(R_1 - R_2)$ between the datum $R_1$ of the register 110 and the datum $R_2$ of the register 115. On the other hand, the 2nd-order differential circuit 119 is constructed as a circuit for computing the difference between the difference of the datum $R_1$ of the register 110 and the datum $R_2$ of the register 115 $(R_1 - R_2)$ and that of the datum $R_2$ of the register and the datum $R_3$ of the register 113 $(R_2 - R_3)$, namely, $(R_1 - R_2) - (R_2 - R_3) = R_1 + R_3 - 2R_2$. In other words, the 2nd-order differential circuit 119 and 1st-order differential circuit 117 perform the above computation upon receipt of data from the registers 110,113,115 and the registers 110,115 respectively.

Figure 10:
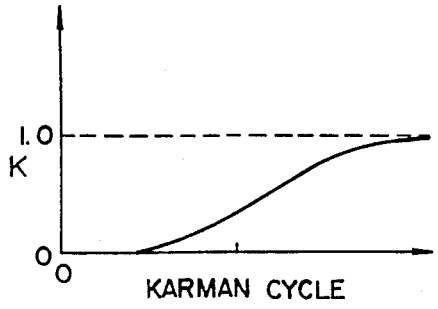

The datum from the 1st-order differential circuit 117 and 2nd-order differential circuit 119 are varied in gain by gain controls 118,120 respectively, added at an adder 121, and then outputted as an output of the transitional correction circuit 109. Here, the gain variations by the gain controls 118,120 are performed based on such characteristics as shown in FIG. 10.

Further, an output from the cycle output circuit 103 and that from the transitional correction circuit 109 are added at an adder 122 and are then outputted as an output of the Karman cycle counter 89A.

The Karman cycle correction circuit 89B is equipped with a first correction unit 90 for correcting the output of the Karman cycle counter 89A in accordance with the intake temperature $T_a$ and a second correction unit 91 for correcting the output of the air-flow sensor 10 in accordance with the atmospheric pressure $P_a$. Also included in the Karman cycle correction circuit 89B are gain controls 92A,92B for subjecting the outputs of the first and second correction units 90,91 to gain variations, an adder 93 for adding the outputs from these gain controls 92A,92B, and a subtractor 94 for subtracting the output of the adder 93 from the output of the Karman cycle counter 89A.

Figure 8:
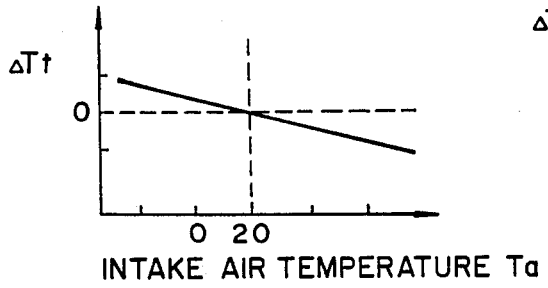
Figure 9:
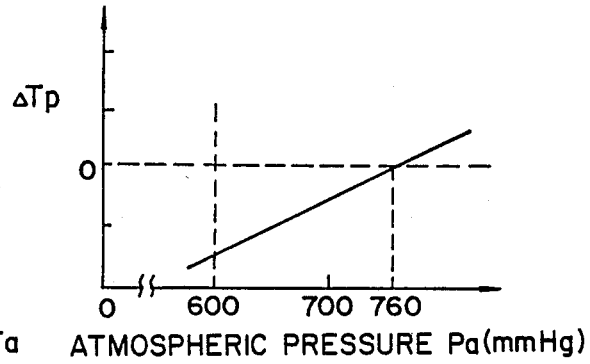
Figure 42:
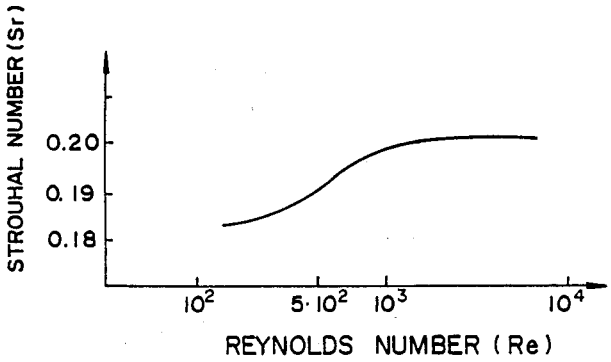
FIG. 42 is a graphic representation of the Strouhal number as a function of the Reynolds number.
Figure 43:
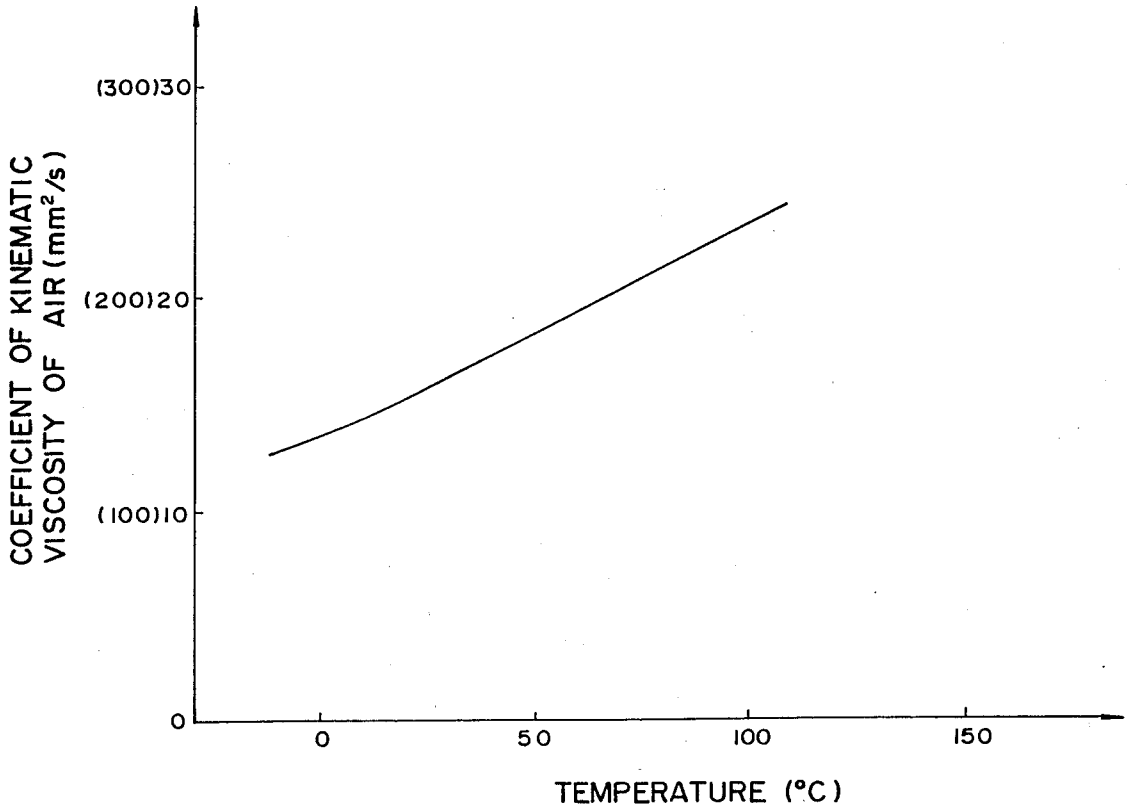
FIG. 43 diagrammatically illustrates the temperature characteristics of the kinematic viscosity coefficient (kinematic viscosity) of air.

Here, the first correction unit 90 outputs information on a cycle difference $\Delta T_t$ which is supposed to be corrected based on the intake air temperature $T_a$ in accordance with such characteristics as shown in FIG. 8, while the second correction unit 91 outputs information on a cycle difference $\Delta T_p$ which is supposed to be corrected based on the atmospheric pressure $P_a$ in accordance with such characteristics as illustrated in FIG. 9. In accordance with such characteristics as depicted in FIG. 10, the gain controls 92A,92B vary the gain K on the basis of the output cycle information (the inverse number of the Karman frequency f) of the Karman cycle counter 89A. The gain characteristics shown in FIG. 10 are of such nature that the lower range of the Strouhal number characteristics shown in FIG. 42 can be compensated.

Inputted to the first correction unit 90 via a switch 87 and A/D converter 70B is a signal from an intake air temperature sensor 20 (which is provided in the intake passage 14 at a point near the air-flow sensor 10 and on the downstream side of the air-flow sensor 10). A signal from the atmospheric pressure sensor 21 is inputted to the second correction unit 91 via a switch 88 and A/D converter 71B.

The switches 87,88 are either closed or opened by an output from a comparator 95. The comparator 95 receives an output, which has been obtained by converting an output from the waveform shaper 17 at an F/V converter 127, and an output from a reference value setting unit 96. When the frequency of the output of the waveform shaper 17 is lower than a reference value (for example, 100 Hz or so) set by the reference value setting unit 96, the comparator 95 outputs a switch closing signal (for example, H signal). Otherwise, the comparator 95 outputs a switch closing signal (for example, L signal).

Since the switches 87,88 are open when the output frequency of the air-flow sensor 10 is higher than 100 Hz, the outputs of the first and second correction units 90,91, hence, those of the gain controls 92A,92B are reduced to zero. When the output frequency of the air-flow sensor 10 becomes lower than 100 Hz, the switches 87,88 are closed so that outputs are delivered respectively from the gain controls 92A,92B subsequent to their correction by the intake air temperature and atmospheric pressure and their gain variations to a suitable extent. These outputs are then added at the adder 93 and subtracted from the output of the Karman cycle counter 89A at the subtractor 94, whereby an output is sent out from the subtractor 94. Namely, the output at this time from the subtractor 94 is an output obtained by correcting the output of the air-flow sensor 10 on the basis of the volumetric flow rate.

The corrected Karman frequency output circuit 89C has a gate 123, presettable counter 124 and clock pulse generator 125. The gate 123 receives an output from the subtractor 94 of the Karman frequency correction circuit 89B and when the presettable counter 124 has counted down to zero, is opened. Upon opening of the gate 123, a datum from the subtractor 94 is delivered to the presettable counter 124. Whenever a clock pulse is inputted from the clock pulse generator 125, the presettable counter 124 performs countdown. When the presettable counter 124 has counted down to zero, a pulse output is delivered from the presettable counter 124. The Karman cycle datum from the subtractor 94 is inputted to the presettable counter 124. When the presettable counter 124 becomes zero next time, a pulse is outputted and at the same time, the next Karman cycle datum from the subtractor 94 is inputted to the presettable counter 124 so as to repeat the countdown. As a consequence, a pulse-train signal having a frequency corresponding to the Karman cycle is outputted from the corrected Karman frequency output circuit 89C. Namely, the output of the corrected Karman frequency output circuit 89C is an output which has been obtained by applying a volumetric flow rate correction to the output frequency of the air-flow sensor 10 in accordance with a change in the viscosity of the kinematic viscosity of air.

A signal, which has been obtained by applying the frequency correction to the output from the air-flow sensor 10 in accordance with the change in the kinematic viscosity in the above-described manner, is inputted as a pulse-train signal to the terminal INT2 of the CPU 19.

No correction is performed when the output frequency of the air-flow sensor 10 is higher than 100 Hz but the above-mentioned correction is conducted when the output frequency is lower than 100 Hz. Since the Strouhal number characteristics are low in the low frequency range (i.e., the frequency range lower than 100 Hz), it is necessary to correct the output of the air-flow sensor 10. In the frequency range higher than 100 Hz, the Strouhal number characteristics are substantially levelled off and the correction of the output from the air-flow sensor 10 is no longer required.

Incidentally, the switches 87,88 may also be provided next to the A/D converter 70B,71B respectively.

As illustrated in FIG. 2, a throttle valve 14*a* which is operated responsive to an accelerator pedal is provided on the downstream side of the air-flow sensor 10 in the intake passage 14. The downstream end of the intake passage 14 is in communication with the intake port of each cylinder head of the 4-cylinder engine 13 by way of an intake manifold 22. In an exhaust passage 24 arranged in communication with the exhaust port of each cylinder of the engine 13 via an exhaust manifold 23, an $O_2$ sensor 25 is provided to detect the concentration of oxygen in the exhaust. Also provided are a water temperature sensor 26 for detecting the temperature of the coolant water of the engine 13, crank angle sensor 27, cylinder discriminating sensor 28, throttle sensor 14*a*-1, and idle switch (idle sensor) 14*a*-2. Signals outputted respectively from these sensors are inputted to the controller 18. The crank angle sensor 27 and cylinder discriminating sensor 28 are provided in a distributor 29. As shown in FIG. 1, the crank angle sensor 27 is composed of teeth 30–33 provided at equal intervals on the outer periphery of a rotor 29*a* of the distributor 29, the number of said teeth being equal to the number of the cylinders, and a pick-up 34 adapted to detect the teeth 30–33 at a fixed position. The crank angle sensor 27 outputs the same number of crank phase signals (engine revolutionary speed information) as the number of the cylinders with every revolution of the distributor 29 (every two crankshaft revolutions) from the pick-up 34.

The cylinder discriminating sensor 28 is composed of a tooth 35 provided on the rotor 29*a* of the distributor 29 and pick-ups 36–39 arranged at equal angular intervals around the rotor 29*a*. From the pick-ups 36–39, signals the number of which is equal to that of the cylinders are outputted successively with every revolution of the distributor 29 (every two crankshaft revolutions).

Electromagnetic fuel injection valves 40–43 are arranged in the individual branch passages of the intake manifold 22 at locations close to the corresponding intake ports. The electromagnetic fuel injection valves 40–43 communicate at one ends thereof to the corresponding branch passages of the intake manifold 22 and at the other ends thereof to an open end of a fuel line which is in turn communicated to a fuel via a fuel pump and fuel pressure regulator. To an opposite end of the fuel line relative to the points of the injection valves 40–43, a fuel of a constant pressure (low pressure) is normally fed owing to the functions of the pump and fuel pressure regulator, so that the fuel in the fuel line is injected into the individual branch passages of the intake manifold 22 when valve needles of the electromagnetic fuel injection valves 40–43 are opened by injector-actuating signals from the controller 18. The quantity of the fuel injected into the branch passages is proportional to the opening time period of the electromagnetic fuel injection valves 40–43.

As depicted in FIG. 1, the controller 18 is constructed of a microcomputer, which includes the CPU 19, ROM 44, RAM 45 and plural ports 46*a*–46*d*, a cylinder discriminating external register 47, a free running counter 48 of 16 bits, registers 49–52, comparators 53–56, R-S flip-flops 57–60, etc. The output signal of the frequency correction circuit 89 is inputted to the interruption terminal INT2 of the CPU 19. The crank phase signal from the pick-up 34 is shaped into a rectangular pulse at a waveform shaper 61 and is then inputted to the interruption terminal INT1 of the CPU 19. On the other hand, the cylinder discriminating signals from the pick-ups 36–39 are shaped into rectangular pulses at waveform shapers 62–65 respectively and are thereafter inputted to the register 47. Signals from the intake air temperature sensor 20, an atmospheric pressure sensor 21, the $O_2$ sensor 25 and water temperature sensor 26 are adjusted to suitable levels by their corresponding level controllers 66–69, are subjected to analog-to-digital conversion by their corresponding analog/digital converters (A/D converters) 70A,71A,72,73, and are then inputted in their corresponding ports 46*a*–46*d*. The above-described microcomputer is also inputted with signals from the starter switch, idle sensor, throttle sensor, etc. The electromagnetic fuel injection valves 40–43 are either opened or closed when the supply of a current to their corresponding valve needle opening/-closing solenoids 40*a*–43*a* from a direct current source (battery) 74 is ON/OFF controlled by their corresponding switching transistors 75–78.

Figure 4:
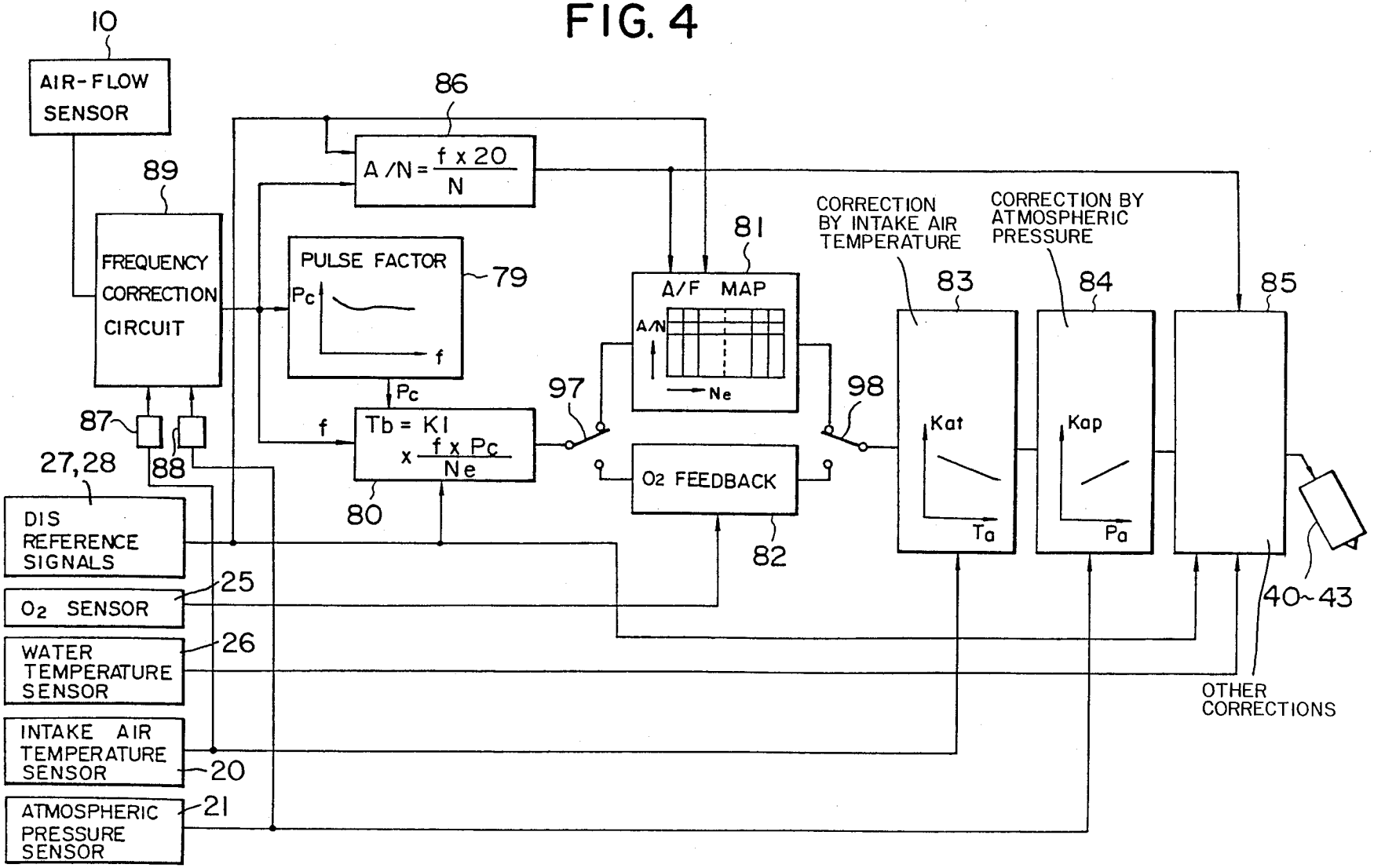

A fuel control system of the L-Jetronic system may be designed as shown in the block diagram of FIG. 4. The control system is equipped with a fuel feed quantity control means which performs corrections by the intake flow rate information from the air-flow sensor 10 and the intake air temperature, atmospheric pressure, exhaust oxygen concentration, coolant water temperature and the like from the intake air temperature sensor 20, atmospheric pressure sensor 21, $O_2$ sensor 25, water temperature sensor 26 and the like so as to control the quantity of the fuel to be injected from the electromagnetic fuel injection valves 40–43. The fuel feed quantity control means is equipped with a pulse constant computing means 79, a basic injection time computing means 80 for determining the basic injection time $T_b$ upon receipt of signals from the pulse constant computing means 79, air-flow sensor 10, crank angle sensor 27 and cylinder discriminating sensor 28, an A/f map (air-to-fuel ratio map) 81, a correction unit 82 adapted during $O_2$ feedback, a correction map 83 by the intake air temperature, a correction map 84 by the atmospheric pressure, and a further map 85.

The pulse constant computing means 79 receives a signal from the air-flow sensor via the frequency correction circuit 89, and determines the pulse constant $P_c$, for example, from a frequency characteristics function for the standard state of intake air temperature and atmospheric pressure (said function being in an inverse relation with the Strouhal number characteristics shown in FIG. 32 and the characteristics being similar to those appearing in the block designated by reference numeral 79 in FIG. 4). The basic injection time computing means 80 calculates the basic injection time $T_b$ from the Karman frequency f, pulse constant $P_c$, engine revolutionary speed $N_e$, etc. The A/F map 81 stores A/F correction factors corresponding to the A/N information (which indicates the quantity of air inducted per revolution of the engine) computed by an A/N computing means 86 and engine revolutionary speeds $N_e$. The correction unit 82 adapted during $O_2$ feedback is used upon controlling the idling or the like. The correction map 83 by the intake air temperature stores intake air density correction factors $K_{at}$ corresponding respectively to intake air temperatures $T_a$ The correction map 84 by the atmospheric pressure stores atmospheric air density correction factors $K_{ap}$ corresponding respectively atmospheric pressures $P_a$. The further map 85 is used to store correction factors for the warm-up period, the time right after start-up and transition periods, and is composed of a plurality of maps.

Designated at numerals 97,98 in FIG. 4 are switching means which are interlocked with each other and are switched over to the same side to select either A/F map 81 or correction unit 82 adapted during $O_2$ feedback.

In order to correct, in accordance with changes in kinematic viscosity $\nu$ of the atmospheric air, the fuel feed quantity control which is performed based on the output of the air-flow sensor, the fuel feed quantity control means is equipped with the fuel feed quantity correcting means which corrects the fuel feed quantity in accordance with the intake air temperature $T_a$ detected by the intake air temperature sensor 20, the atmospheric pressure $P_a$ detected by the atmospheric pressure sensor 21 and the information f on the frequency outputted from the air-flow sensor 10. In the present embodiment, the fuel feed quantity correcting means comprises the frequency correction circuit 89 which corrects the above-described frequency outputted from the air-flow sensor 10.

Incidentally, the basic fuel feed quantity required per unit time is proportional to the volume of air inducted in the engine per unit time. When one wants to actuate an electromagnetic fuel injection valve with every crank phase signal, it is hence only necessary to set a datum, which serves to give a basic valve-opening time period (actuation pulse width) per injection of the electromagnetic fuel injection valve, in accordance with the volume of air inducted between two adjacent crank phase signals. In the present embodiment, information on the volume of air inducted between each two adjacent crank phase signals is obtained on the basis of the number of Karman vortex signals generated between said each two adjacent crank phase signals, and the above-described datum on the basic valve opening time period is set based on the above information.

The setting of the datum on the basic valve opening time period, the subsequent setting of a datum on an actual valve opeing time period, and the setting of a correction datum on the basis of various operation states of the engine for use upon setting the datum on the actual valve opening time period are all performed by computation at the CPU 19. A description will next be made of an operation which the CPU 19 performs in accordance with a program by using the RAM 45. The program has been stored in the ROM 44.

Figure 5:
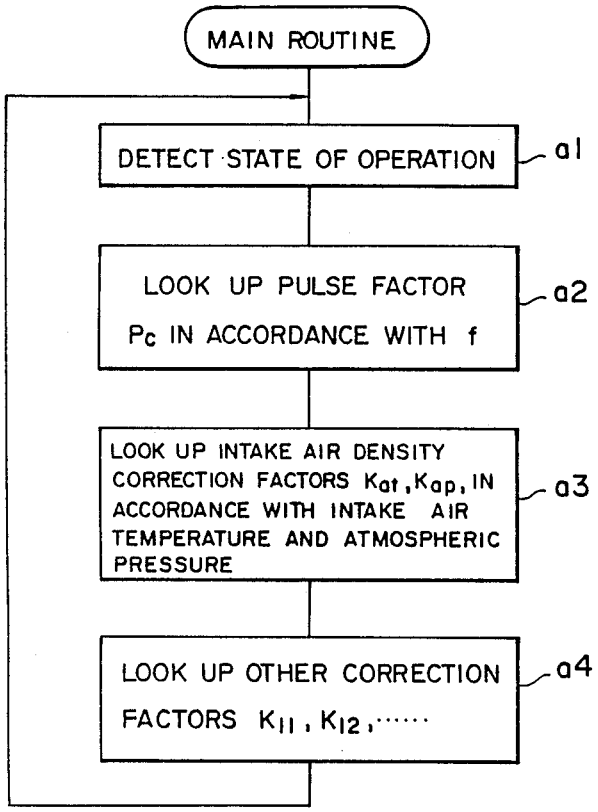
Figure 6:
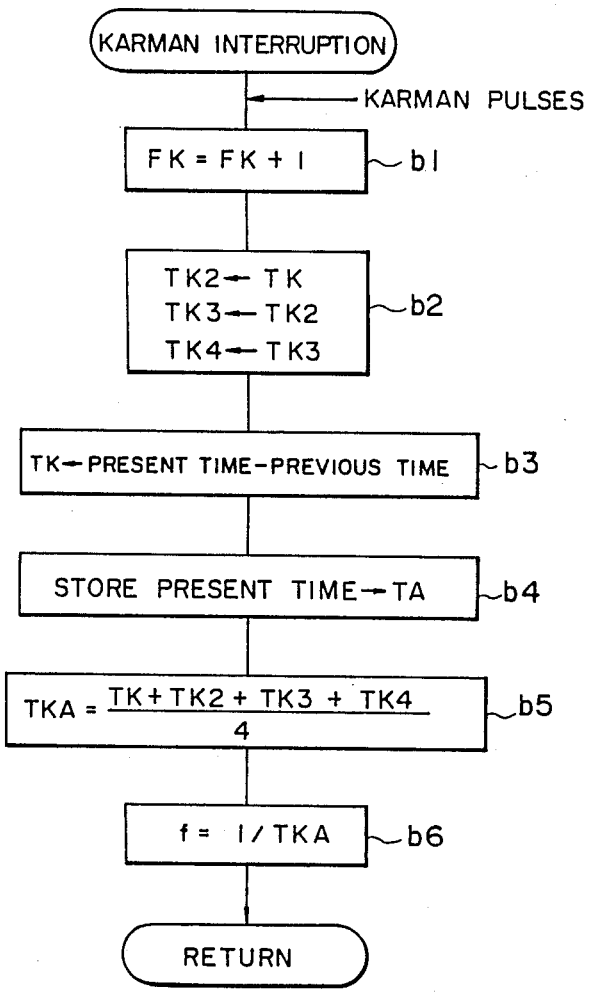

Upon controlling firstly the quantity of the fuel to be fed, the main routine shown in FIG. 5 is performed. In the main routine, the state of an operation is detected in Step al. By the pulse constant computing means 79, a pulse constant $P_c$ is looked up in accordance with a frequency f which has been obtained by correcting an output of the air-flow sensor 10 by the frequency correction circuit 89 (Step a2). By the intake air temperature correction map 83 and atmospheric pressure correction map 84, intake air density correction factors $K_{at}$,$K_{ap}$ are looked up based on an intake air temperature $T_a$ and an atmospheric pressure $P_a$ respectively (Step a3). In addition, other correction factors $K_{11}$,$K_{12}$, . . . are looked up by the additional map 85 (Step a4).

The frequency f employed in Step a2 is computed in the CPU 19. Such computation is performed with every Karman pulse interruption in the Karman interruption routine depicted in FIG. 6. When a Karman vortex signal corrected by a volumetric flow rate is inputted from the frequency correction circuit 89 to the interruption terminal INT2 of the CPU 19, 1 is added first of all to the datum stored at an address FK of the RAM 45 in Step b1, and the data of addresses TK2,TK3,TK4 of the RAM 45 are then renewed by the data of addresses TK,TK2,TK3 (Step b2). In Step b3, the present value of the free running counter 48 is thereafter read in, and the difference between the value just read in and another value of the free running counter 48, the latter value having been read in upon performance of the program last time and inputted in an address TA of the RAM 45, is determined, in other words, the difference between the present time and the last time is determined. This difference datum is then inputted to the address TK of the RAM 45. Next, a further value of the free running counter 48 which has been read in during the present performance of the program is inputted to the address TA in Step b4. Thereafter, in Step b5, the average of the renewed data of the addresses TK,TK2,TK3,TK4 is calculated to renew the datum of the address TKA. In Step b6, the inverse number of the datum of the address TKA is computed to determine the frequency f.

Incidentally, an interrupt processing by a crank phase signal (crank phase interruption routine) which will be described subsequently takes precedence of the Karman interruption routine. When a crank phase signal is inputted while the Karman interruption routine is being performed, the performance of the Karman interruption is interrupted once at that time and after completion of the interrupt processing by the crank phase signal, the Karman interruption routine is performed from the point of the interruption.

Figure 7:
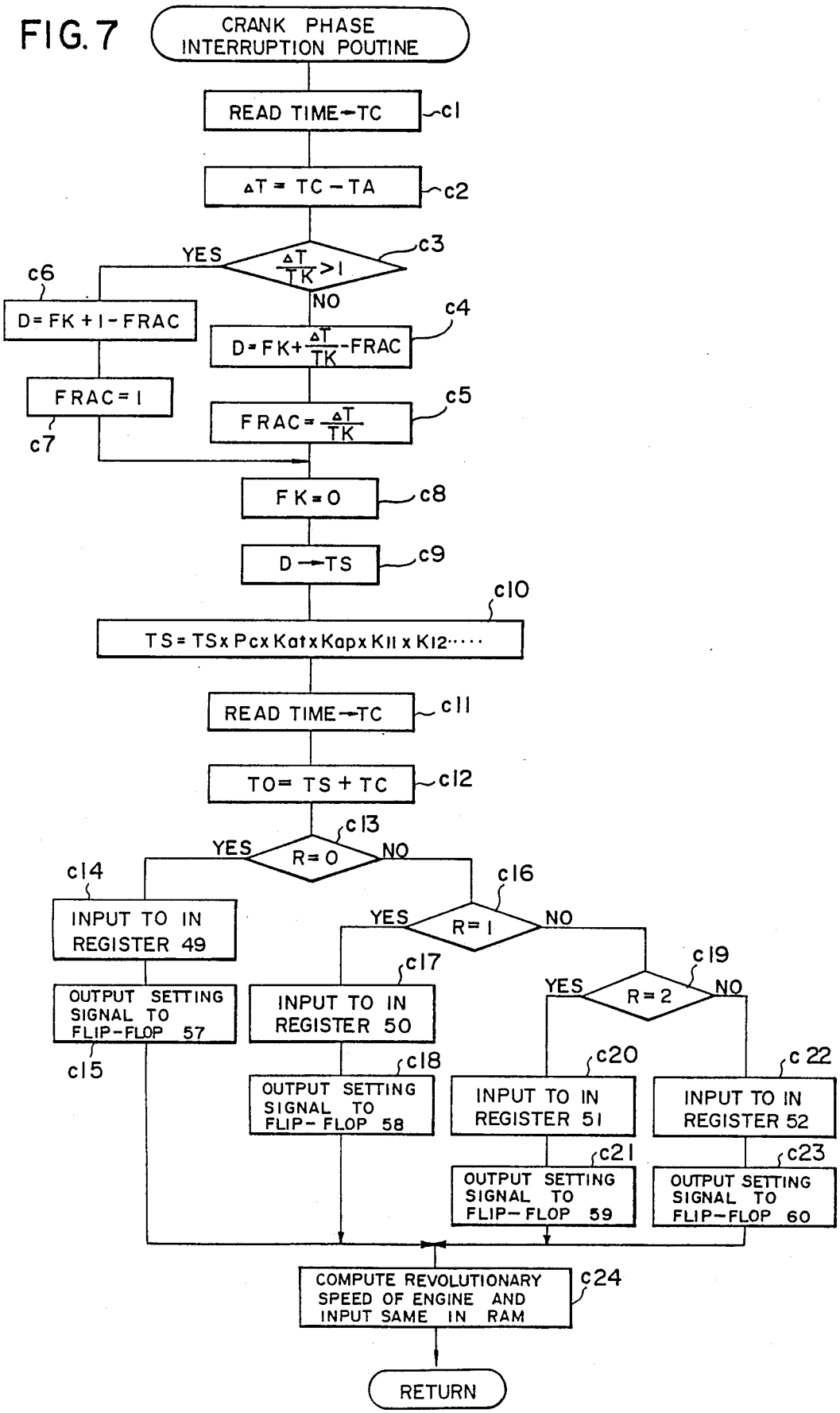

Illustrated in FIG. 7 is the crank phase interruption routine which performs an interrupt processing with every input of crank phase signal to the terminal INT1 of the CPU 19. When a crank phase signal is inputted from the waveform shaper 61 to the terminal INT1 of the CPU 19, the value of the free running counter 48 is first read in and stored at an address TC of the RAM 45 in Step cl. Determined next in Step c2 is the difference $\Delta T$ between the value of the free running counter 48 at the time of occurrence of the crank phase signal read in in Step cl and the value of the free running counter 48 at the time of the generation of the latest Karman vortex signal, the latter value having already been read in and stored at the address TA in Step b4 of the Karman interruption routine. The datum $\Delta T$ is stored at a desired address of the RAM 45 as needed. In Step c3, the difference datum $\Delta T$ determined in Step c2 is then divided by the datum which has been determined and stored at the address TK in Step b3 of the Karman interruption routine. The datum of the quotient obtained as a result of the division is thereafter compared with 1 as a ceiling value. When the datum of the quotient is found not to be greater than 1 as a result of the comparison in Step c3, the routine advances to Step c4. In Step c4, the datum of the above quotient is added to the datum of the pulse number of the Karman vortex signals, which has been determined and stored at an address FK in Step b1 of the Karman interruption routine, followed by subtraction of the datum stored at an address FRAC of the RAM 45. Results of this computation are stored at an address D of the RAM 45. As will become apparent from a subsequent description on Step c5 and Step c7, the datum of the above-described quotient determined by the last performance of the crank phase interruption routine (hereinafter called "the last quotient datum") is stored at the address FRAC. When the last quotient datum exceeds the ceiling value 1, the ceiling value 1 is stored. In Step c5 which follows Step c4, the datum of a quotient determined in Step c3 of the present performance of the crank phase interruption routine is stored at the address FRAC. The quotient datum just stored at the address FRAC in Step c5 will be used in Step c4 of the next performance of the crank phase interruption routine and upon computation in Step c6, which computation will be described subsequently. Subsequent to Step c5, Step c8 is reached. When the quotient datum is found to be greater than the ceiling value 1 in Step c3 on the other hand, the routine advances Step c6 in which the ceiling value 1 is added to the datum of the number of occurrence of Karman vortex signals, said datum having been stored at the address FK, and the datum stored at the address FRAC is then subtracted. Results of this computation are stored at the address D. AT this time, the datum of the address RRAC is the same as that in Step c4 described above. In Step c7 which follows Step c6, the ceiling value 1 is stored at the address FRAC. The datum of the ceiling value stored at the address FRAC in Step c7 will be used upon computation in Step c4 and Step c6 of the next performance of the crank phase interruption routine. After Step c7, Step c8 is reached.

In Step c8, the datum of the address FK is reset to 0. In Step c9, the datum $D_1$ stored at the address D is next converted into its corresponding datum $TS_1$ which gives the valve opening time of the electromagnetic fuel injection valves (actuation pulse width), and is then stored at an address TS of the RAM 45. Incidentally, the datum $D_1$ and time data $TS_1$ are basically in the following relation, $TS_1 - a \cdot D_1$ (a: positive constant). The value of the positive constant a is stored in the ROM 44. In Step c10, the data of the address TS is next multiplied by data of the various factors $P_c, K_{at}, K_{ap}, K_{11}, K_{12}, \ldots$ determined in the main routine, and the product is stored again at the address TS. Thereafter, the value of the free running counter 48 is again read in and is stored at the address TC in Step c11. In Step 12, the datum of the address TS is added to the datum of the address TC to calculate the sum TO. It is then judged in Step 13 whether the datum R of the cylinder discriminating external register 47 is 0 or not.

In the 4-cylinder engine 13, the fuel is injected repeated from the electromagnetic fuel injection valves 40–43 in the order of the first cylinder, third cylinder, fourth cylinder and second cylinder. Each cylinder into which the fuel is to be injected is detected by the cylinder discriminating sensor 28 and results of the detection are inputted to the cylinder discriminating external register 47. When the datum R of the register 47 is 0 (first cylinder signal), in other words, the fuel is to be injected into the first cylinder by the electromagnetic fuel injection valve 40, the routine advances Step c14 where the sum TO is set in the register 49. In step c15, a setting signal is outputted to the flip-flop 57. The flip-flop 57 is thus set by the setting signal so that the transistor 75 is turned on by a signal outputted from the flip-flop 57. The solenoid 40*a* is hence actuated to open the electromagnetic fuel injection valve 40, whereby the fuel is injected into the first cylinder. When the value of the free running counter 48 subsequently reaches the value TO of the register 49 and a signal is outputted from the comparator 53, the flip-flop 57 is reset by the output signal of the comparator 53 so that the transistor 75 is turned off. As a result, the solenoid 40*a* is electrically deenergized to close the electromagnetic fuel injection valve 40.

In Steps c13,c16,c19, the CPU 19 judges whether the datum R of the cylinder discriminating external register 47 is 0 (first cylinder signal), 1 (second cylinder signal) or 2 (third cylinder signal). Where the datum R of the register 47 is found not to be 0 in Step 13, the routine advances to Step c16. When the datum R of the register 47 is found to be 1 as a result of the judgement in Step 16, the routine advances to Step c17 so as to set the above-described value TO in the resister 50. In Step c18, a setting signal is outputted to the flip-flop 58. The flip-flop 58 is set by the setting signal. The transistor 76 is turned on by a signal outputted from the flip-flop 58, whereby the solenoid 41*a* is electrically energized to open the electromagnetic fuel injection valve 41 and the fuel is thus injected into the second cylinder. When the value of the free running counter 48 subsequently reaches the value of the register 50 and a signal is outputted from the comparator 54, the flip-flop 58 is reset by the output signal of the comparator 54 to turn off the transistor 76. Thus, the solenoid 41*a* is electrically deenergized to close the electromagnetic fuel injection valve 41.

When the datum R of the register 47 is found not to be 1 as a result of the judgement by the CPU 19 in Step c16, the routine advances to Step c19. When the datum of the register 47 is found to be 2 by the judgement in Step c19, the routine advances to Step c20 so that the value TO is set in the register 51. In Step c21, a setting signal is outputted to the flip-flop 59. The flip-flop 59 is set by the setting signal. By a signal outputted from the flip-flop 59, the transistor 77 is turned on to electrically energize the solenoid 42*a*. As a result, the electromagnetic fuel injection valve 42 is opened to inject the fuel into the third cylinder. When the value of the free running counter 48 subsequently reaches the value of the register 51 and a signal is hence outputted from the comparator 55, the flip-flop 59 is reset by the output signal of the comparator 55 to turn off the transistor 77. Thus, the solenoid 42*a* is electrically deenergized to close the electromagnetic fuel injection valve 42.

When the datum R of the register 47 is found not to be 2 as a result of the judgement by the CPU 19 in Step c19, the routine advances to Step c22 where the above value TO is set in the register 52. In Step c23, a setting signal is outputted to the flip-flop 60. The flip-flop 60 is set by the setting signal. By a signal outputted from the flip-flop 60, the transistor 78 is turned on to turn on the transistor 77. As a result, the electromagnetic fuel injection valve 43 is opened to inject the fuel into the fourth cylinder. When the value of the free running counter 48 subsequently reaches the value of the register 52 and a signal is hence outputted from the comparator 56, the flip-flop 60 is reset by the output signal of the comparator 56 to turn off the transistor 78. Thus, the solenoid 43*a* is electrically deenergized to close the electromagnetic fuel injection valve 43.

Since the cylinder discriminating sensor 28 outputs first cylinder signal, third cylinder signal, fourth cylinder signal and second cylinder signal successively and repeatedly as the rotor 29*a* of the distributor 29 revolves, the electromagnetic fuel injection valves 40–43 are opened in the order of 40, 42, 43 and 41 so that the fuel is injected in the order of the first cylinder, third cylinder, fourth cylinder and second cylinder.

The CPU 19 advances from Steps c15,c18,c21,c23 to Step c24, where the datum of time between adjacent crank phase signals from the waveform shaper 61 is detected from the difference between pieces of time datum of the free running counter 48 (the pieces of input time datum of the crank phase signals) so as to store plural pieces of time datum right before the latest time datum as needed. The datum of an engine revolutionary speed (cycle datum which is the inverse number of the revolutionary speed of the engine) is calculated by averaging these pieces of time datum right before the latest time datum and the latest time datum and is then stored at one of the addresses of the RAM 45 to complete the interrupt processing. Since the above cycle datum is a datum per 180° revolution of the crank, its inverse number constitutes a datum of a size twice the engine revolutionary speed.

Since the datum of the address FK is reset to 0 every time in Step c8 of the crank phase interruption routine, the multiplication of the Karman vortex signal performed in Step b1 of the Karman interruption routine is started from 0 with every generation of crank phase signal. Accordingly, the value of the datum of the address FK inputted to the address D in Step c4 or Step c6 at the time of generation of a desired crank phase signal in the crank phase interruption routine corresponds to the pulse number of Karman vortex signals generated from the occurrence of the latest crank phase signal preceding the desired crank phase signal until the occurrence of the desired crankphase signal.

In the crank phase interruption routine, it is performed in Step c2 to subtract the value of the free running counter, which was inputted to the read address TA in Step b3 of the Karman interruption routine at the time of generation of the latest Karman vortex signal preceding the crank phase signal read in Step cl of the crank phase interruption routine, from the value of the free running counter 48 at the time of occurrence of the crank phase signal read n Step c1, whereby their difference is determined. To determine the difference corresponds to the measurement of the time interval between a crank phase signal as a trigger signal and a Karman vortex signal which constitutes the latest pulse signal preceding the crank phase signal.

In Step c3 of the crank phase interruption routine, it is performed to divide the time interval $\Delta T(n)$ between a desired crank phase signal C(n) and the latest Karman vortex signal K(i) preceding the desired crank phase signal C(n) by the time interval tk(i) between the Karman vortex signal K(i) and the latest Karman vortex signal K(i−1) preceding the Karman vortex signal K(i). The former time interval $\Delta T(n)$ has been determined in Step c2 performed right before, while the latter time interval tk(i) has been determined and stored at the address TK at the time of occurrence of the above Karman vortex signal K(i) in the Karman vortex interruption routine. The division is nothing but the conversion of the former time interval datum $\Delta T(n)$ into the pulse number of Karman vortices. Namely, the datum $\Delta T(n)$ indicates the datum of the time interval until the time point of generation of the crank phase signal C(n) during the time interval tk(i+1) between the Karman vortex signal K(i) and the first karman vortex signal K(i+1) following the Karman vortex signal K(i). Let's now assume hypothetically that the quantity of air inducted from the time point of occurrence of the Karman vortex signal K(i) until the time point of generation of the Karman vortex signal K(i+1) is constant. Since the time interval datum tk(i+1) corresponds to the datum 1 of the number of Karman vortices, the datum which is obtained by dividing $\Delta T(n)$ with tk(i+1) is equal to that obtained by converting into the number of Karman vortices the time interval datum between the Karman vortex signal K(i) and the crank phase signal C(n). By deeming that the datum tk(i) is equal to the datum tk(i+1), the division of the datum $\Delta T(n)$ by the datum tk(i) is equivalent to the conversion of the time interval datum $\Delta T(n)$ into the corresponding pulse number of Karman vortices.

Upon performing the conversion of the time interval datum $\Delta T(n)$ into its corresponding number of Karman vortex signals, the datum tk(i) and datum tk(i+1) are assumed to be equal to each other. Since the datum $\Delta T(n)$ never exceeds the data tk(i+1), the data of a quotient obtained by dividing the datum $\Delta T(n)$ with the datum tk(i+1) has extremely low reliability if the datum is greater than 1.

The quotient datum greater than 1 results in an indication of the existence of a karman vortex signal between both signals K(i) and C(n) in spite of the fact that no Karman vortex signal is supposed to exist actually between the Karman vortex signal K(i) and the crank phase signal C(n). With the foregoing in view, it is judged in Step c3 whether the quotient datum is greater than 1 or not. When the quotient datum is not found to exceed 1, the quotient datum is added as is in Step c4. When it is found to be greater than 1, the quotient datum is replaced by the ceiling value 1 and the ceiling value 1 is added in Step c6.

In Step c4 and Step C6 of the crank phase interruption routine at the time of occurrence of a desired crank phase signal C(n), a datum (ceiling value 1) which has been obtained by converting the time interval between the crank phase signal C(n) and the latest Karman vortex signal preceding the crank phase signal C(n) into its corresponding number of Karman vortex signals is added to the datum of the pulse number of Karman vortex signals occurred between the crank phase signal C(n) and the latest crank phase signal C(n−1) preceding the crank phase signal C(n). Subtracted next is a datum which has been obtained by converting the time interval between the crank phase signal C(n−1) and the latest Karman vortex signal preceding the crank phase signal C(n−1) into its corresponding number of Karman vortex signals, whereby a datum relating to the information on the quantity of air inducted between crank phase signal C(n−1) and the crank phase signal C(n) is obtained. The thus-obtained datum is inputted to the address D. The datum of the address D is corrected by data of various factors and is then converted into the datum of its corresponding valve opening time (actuation pulse width) of the electromagnetic fuel injection valves.

Since the possible reduction of the accuracy of the fuel injection control can be avoided by correcting the output frequency of the air-flow sensor 10 in accordance with variations in kinematic viscosity of air in the manner described above, a precise fuel feed quantity control can be materialized.

A description will next be made of the fuel feed quantity control system of the second embodiment of this invention shown in FIGS. 11–18, which is also suitable for use with an engine. In each of the drawings, the same reference symbols as those in FIGS. 1–10 indicate substantially the same elements of structure. Accordingly, the elements of structure common to the first embodiment described above are omitted herein.

Figure 11:
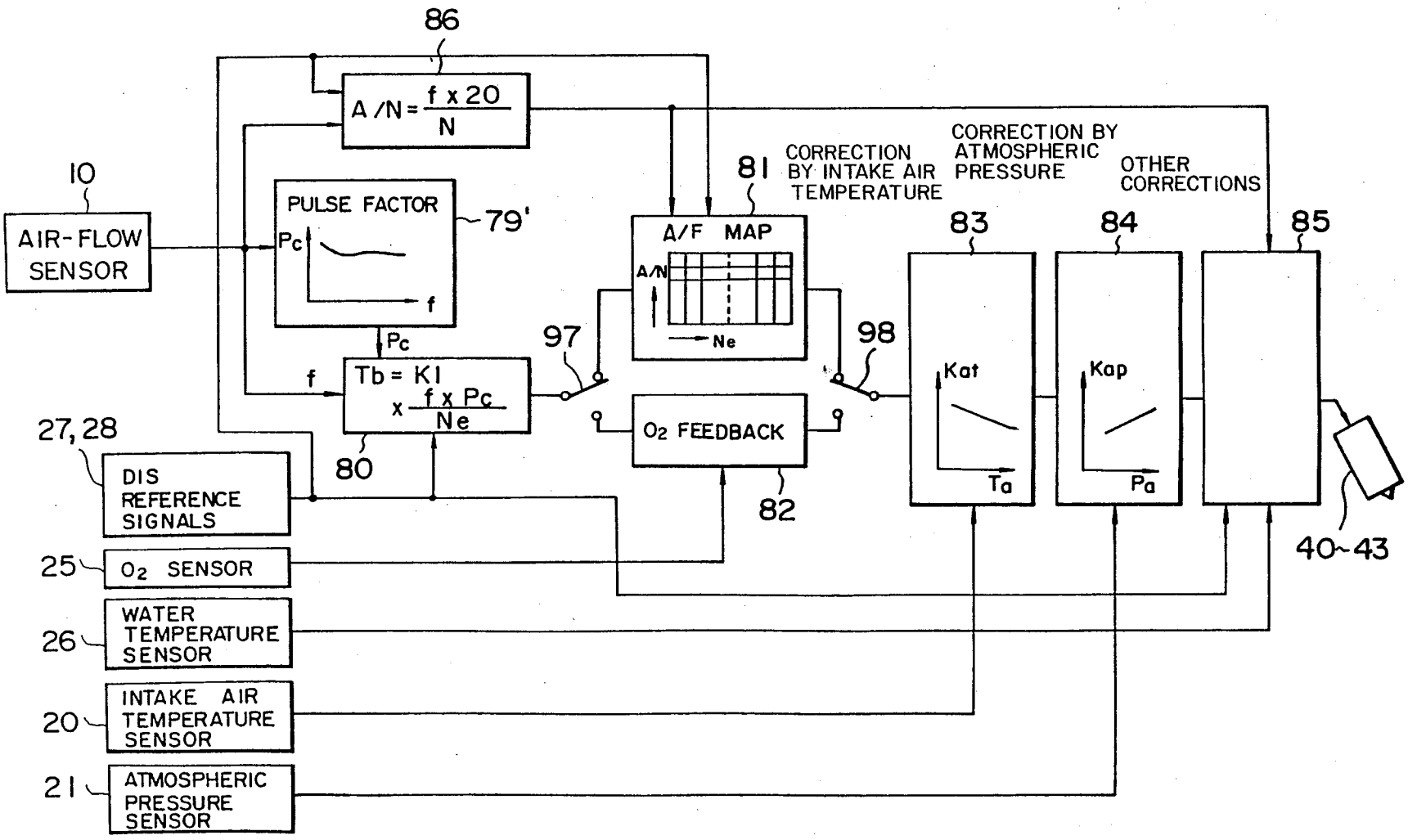
Figure 12:
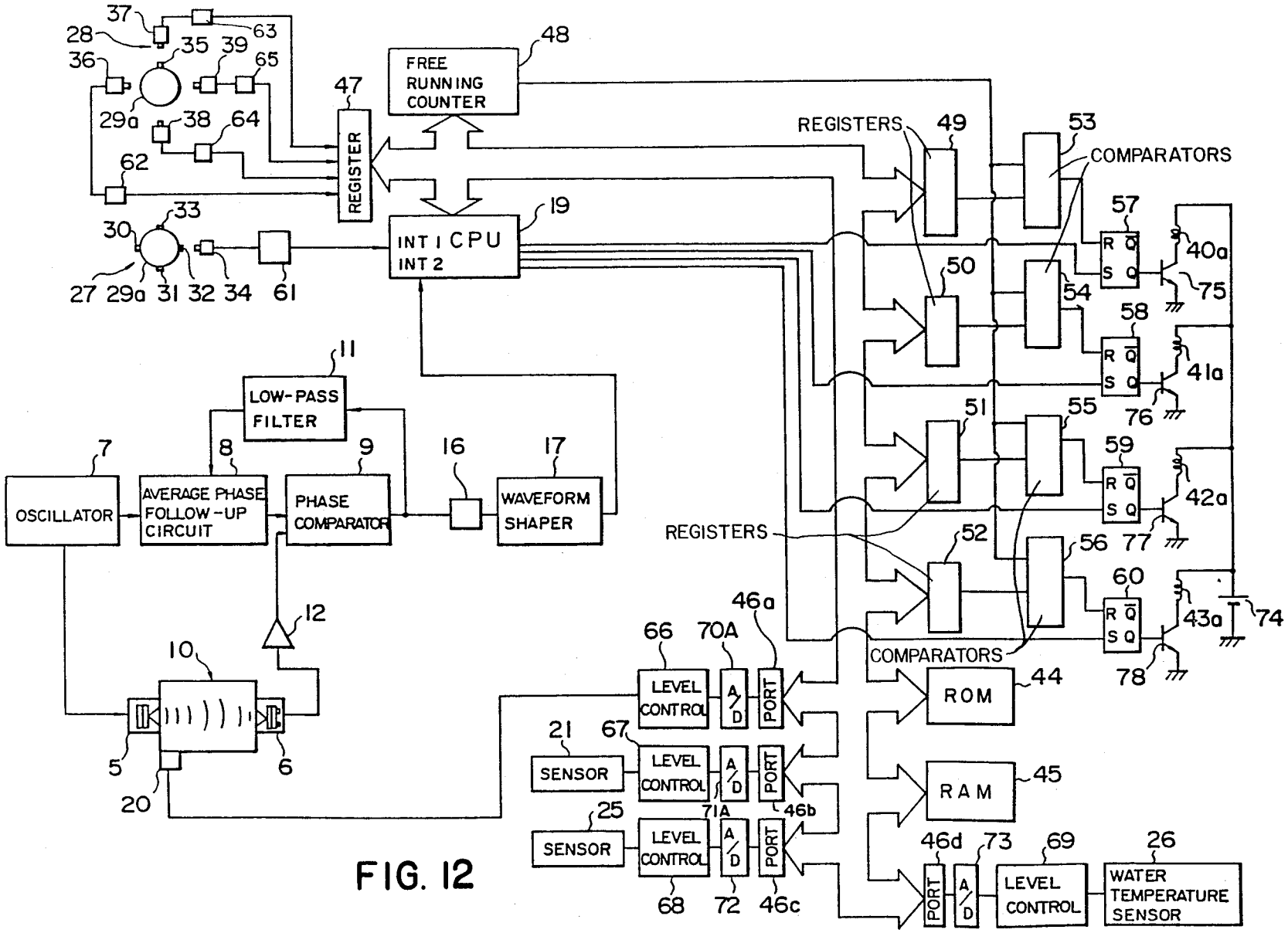

First of all, the fuel control block diagram of the second embodiment may be illustrated as shown in FIG. 11 and its electric circuit diagram for the control of fuel may also be depicted as shown in FIG. 12. As will be appreciated from these drawings, the output of the air-flow sensor 10 is not subjected to such a frequency correction as applied in the first embodiment before it enters the CPU 19. In this embodiment, the pulse signal from the air-flow sensor is inputted to the CPU 19 without any correction. Upon subsequent determination of the pulse constant $P_c$, the detection frequency from the air-flow sensor 10 is corrected in accordance with a variation in kinematic viscosity of air by software in the CPU 19. The correction include a correction by a variation in the intake air temperature $T_a$ and a correction by a variation in the atmospheric pressure $P_a$. For the same reasons as in the first embodiment, this correction is performed for the lower Strouhal number range (the range lower than 100 Hz in terms of Karman frequency).

Figure 13:
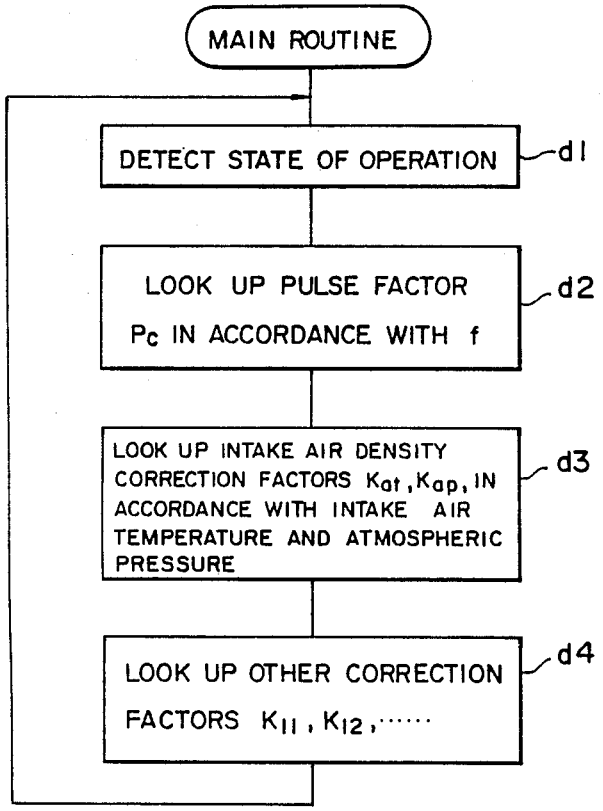
Figure 14:
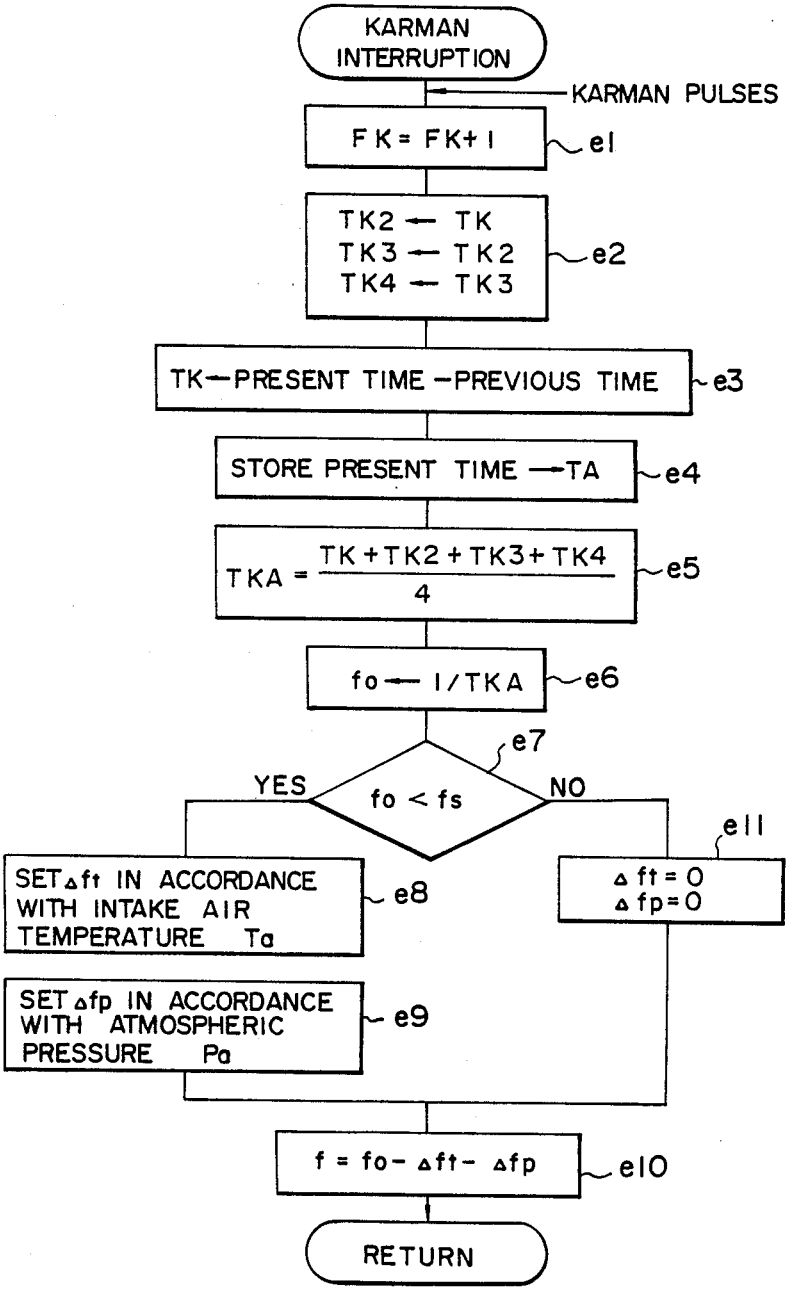

The fuel feed quantity control by the second embodiment will hereinafter be described in detail. Reference is had first of all to FIG. 13, in which the main flow is illustrated. An operation state is detected (Step d1), a pulse constant $P_c$ is looked up based on Karman frequency information f (Step d2), intake air density correction factors $K_{at}$,$K_{ap}$ are looked up in accordance with intake air temperature $T_a$ and atmospheric pressure $P_a$ (Step d3), and other correction factors $K_{11}$,$K_{12}$, . . . . are looked up (Step d4).

Since the frequency information f used in Step d2 has not been corrected in accordance with a variation in kinematic viscosity unlike the first embodiment, it is necessary to correct the frequency information f upon determination of the quantity of the fuel to be fed. For this purpose, correction of this information f is performed in the Karman interruption routine illustrated in FIG. 14. When a Karman vortex signal is inputted from the waveform shaper 17 to the interruption terminal INT 2 of the CPU 19, 1 is firstly added to the datum retained at the address FK of the RAM 45 in Step el, followed by renewal of the data of the address TK2,TK3,TK4 of the RAM 45 with those of the address TK,TK2,TK3 respectively (Step e2). In Step e3, the present value of the free running counter 48 is next read in, the difference between the value just read in and the value of the free running counter 48 read in and stored in the address TA of the RAM 45 in the course of the previous performance of the program is determined, in other words, the difference between the present time and the previous time is determined, and the datum f the difference is inputted to the address TK of the RAM 45. The routine next advances to Step e4, where the value of the free running counter 48 read in upon performance of the program this time is inputted to the address TA. Thereafter, the average of the thus-renewed data of the address TK,TK2,TK3,TK4 is obtained to renew the datum of the address TKA in Step e5. In Step e6, the inverse number of the datum of the address TKA is computed to determine the frequency $f_o$.

The frequency datum $f_o$ is next compared with the datum of a preset value $f_s$ (for example, a value corresponding to 100 Hz or a frequency somewhat higher than 100 Hz) in Step e7. If $f_o < f_s$, $\Delta f_t$ is set in accordance with the intake air temperature $T_a$ in Step e8. The routine then advances to Step e9, where $\Delta f_p$ is set in accordance with the atmospheric pressure $P_a$.

Figure 16:
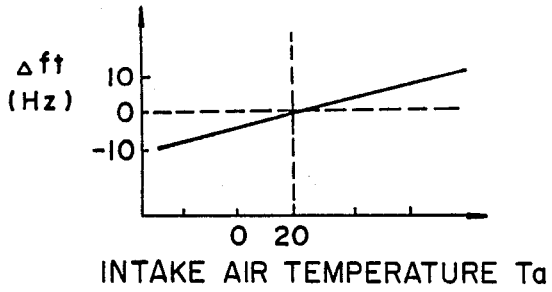
Figure 17:
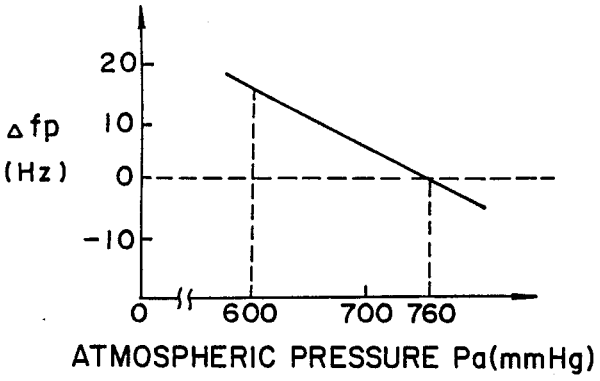

The intake air temperature $T_a$ and $\Delta f_t$ have such relationship as shown in FIG. 16, while the relationship between the atmospheric pressure $P_a$ and $\Delta f_p$ is illustrated as shown in FIG. 17. It is hence possible to determine $\Delta f_t$ and $\Delta f_p$ from the relations shown in these drawings provided that the intake air temperature $T_a$ and atmospheric pressure $P_a$ are known.

Computation, $f = f_o - \Delta f_t - \Delta f_p$, is then performed in Step e10, following by the returning of the routine.

If the relation of $f_o < f_s$ is not found in Step e7 on the other hand, $\Delta f_t$ and $\Delta f_p$ are set to 0 in Step ell so as to perform the processing of Step e10. In this case, $f = f_o$ is used in Step e10.

In the range lower than 100 Hz in terms of Karman frequency, the frequency correction values $\Delta f_t$,$\Delta f_p$ which are determined in accordance with the intake air temperature $T_a$ and atmospheric pressure $P_a$ respectively are subtracted from the Karman frequency information $f_o$ inputted to the CPU 19 from the air-flow sensor 10 as described above, whereby the correction is feasible even in the lower Strouhal number range. In the range higher than 100 Hz in terms of Karman frequency on the other hand, the above correction is not required and the output frequency $f_o$ from the air-flow sensor is used as is.

Figure 18:
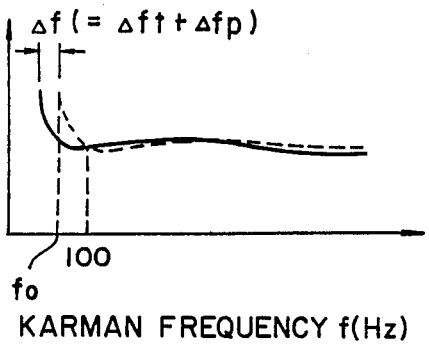

Accordingly, the setting of the pulse constant $P_c$ based on f, which is performed in Step d2 of the main routine shown in FIG. 13, is performed by choosing a pulse constant $P_c$ in a range lower by $\Delta f$ ($= \Delta f_t$ $\Delta f_p$) from the Karman frequency $f_o$ detected by the air-flow sensor 10 as depicted in FIG. 18. In FIG. 18, the pulse constant-Karman frequency characteristics curve for a standard intake air temperature (e.g., 20° C.) and a standard atmospheric pressure (e.g., 760 mmHg) is indicated by a solid line while that for different intake air temperature and atmospheric pressure are shown by broken line. So long as only one characteristics curve, for example, the characteristics curve for the standard intake air temperature and standard atmospheric pressure is provided regarding the pulse constant-Karman frequency characteristics (see the characteristics curve indicated by the solid line in FIG. 18), the above-described manner of selection of the pulse constant $P_c$ still allows to convert the characteristics indicated by the broken line into their corresponding characteristics shown by the solid line even if the conditions of the intake air temperature and atmospheric pressure change from their standard states to the different states. Provided that a pulse constant $P_c$ corresponding to the Karman frequency at $f_o - \Delta f$ is looked up, a suitable pulse constant $P_c$ can be chosen in a form corrected with respect to the output frequency from the air-flow sensor 10 by taking into consideration a change in kinematic viscosity of air.

The above frequency correction is performed by a pulse constant computing means 79' depicted in FIG. 11. In the second embodiment, the pulse constant computing means 79' therefore makes up the fuel feed quantity correction means which corrects the fuel feed quantity in accordance with the intake air temperature $T_a$, atmospheric pressure $P_a$ and output frequency information from the air-flow sensor 10 so as to correct the fuel feed quantity control, which is in turn performed based on the output of the air-flow sensor, in accordance with changes in kinematic viscosity of the atmospheric air.

Where the pulse constant computing means 79' is provided with a plurality of pulse constant characteristics for different intake air temperatures and atmospheric pressures (see the solid characteristics curve and broken characteristics curve in FIG. 18), pulse constant characteristics at given intake temperature and atmospheric pressure may be looked up from the plural pulse constant characteristics or are determined by interpolation, and the pulse constant for the given intake temperature and atmospheric pressure may then be obtained by adding the pulse constant deviation $\Delta P_c$ from the standard characteristics (the solid characteristics curve in FIG. 18) to the corresponding pulse constant $P_c$ on the standard characteristics curve.

Figure 15:
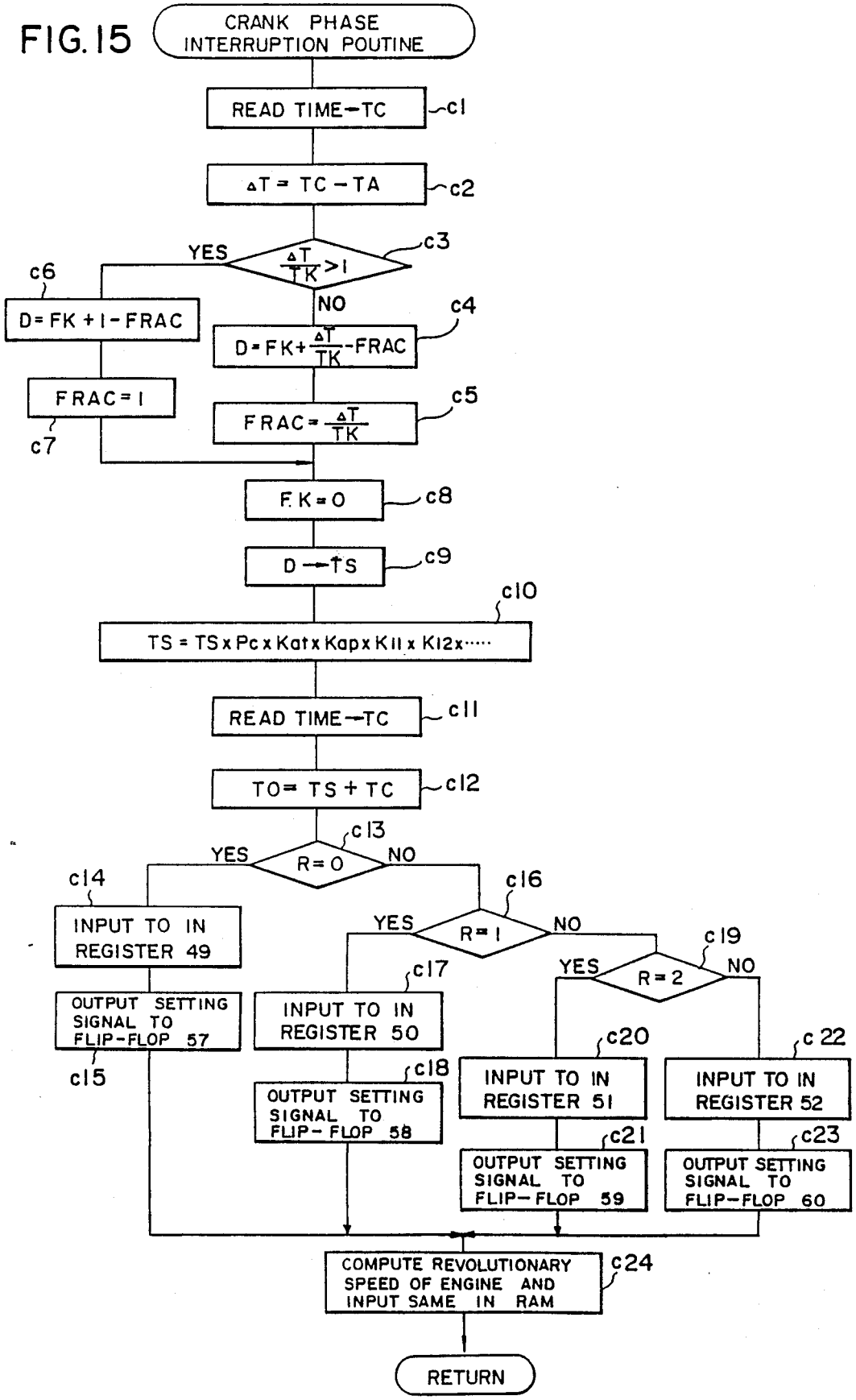

The crank phase interruption routine, which is a specific fuel injection control routine, may be illustrated as shown in FIG. 15. Since this routine is the same as the crank phase interruption routine depicted in FIG. 7 and described above with respect to the first embodiment, its description is omitted herein and instead, the corresponding steps are identified by the same reference symbols.

The second embodiment can also prevent the possible reduction of the accuracy of the fuel injection control by correcting the output frequency from the air flow-sensor 10 in accordance with changes in kinematic viscosity of air, thereby materializing an accurate control on the quantity of the fuel to be fed.

The fuel feed quantity control system of the third embodiment of this invention shown in FIGS. 19–25, which is also suitable for use with an engine, will next be described. In each of the drawings, the same reference symbols as those in FIGS. 1–18 indicate substantially the same elements of structure. Thus, the elements of structure common to the first and/or second embodiments described above are omitted herein.

Figure 19:
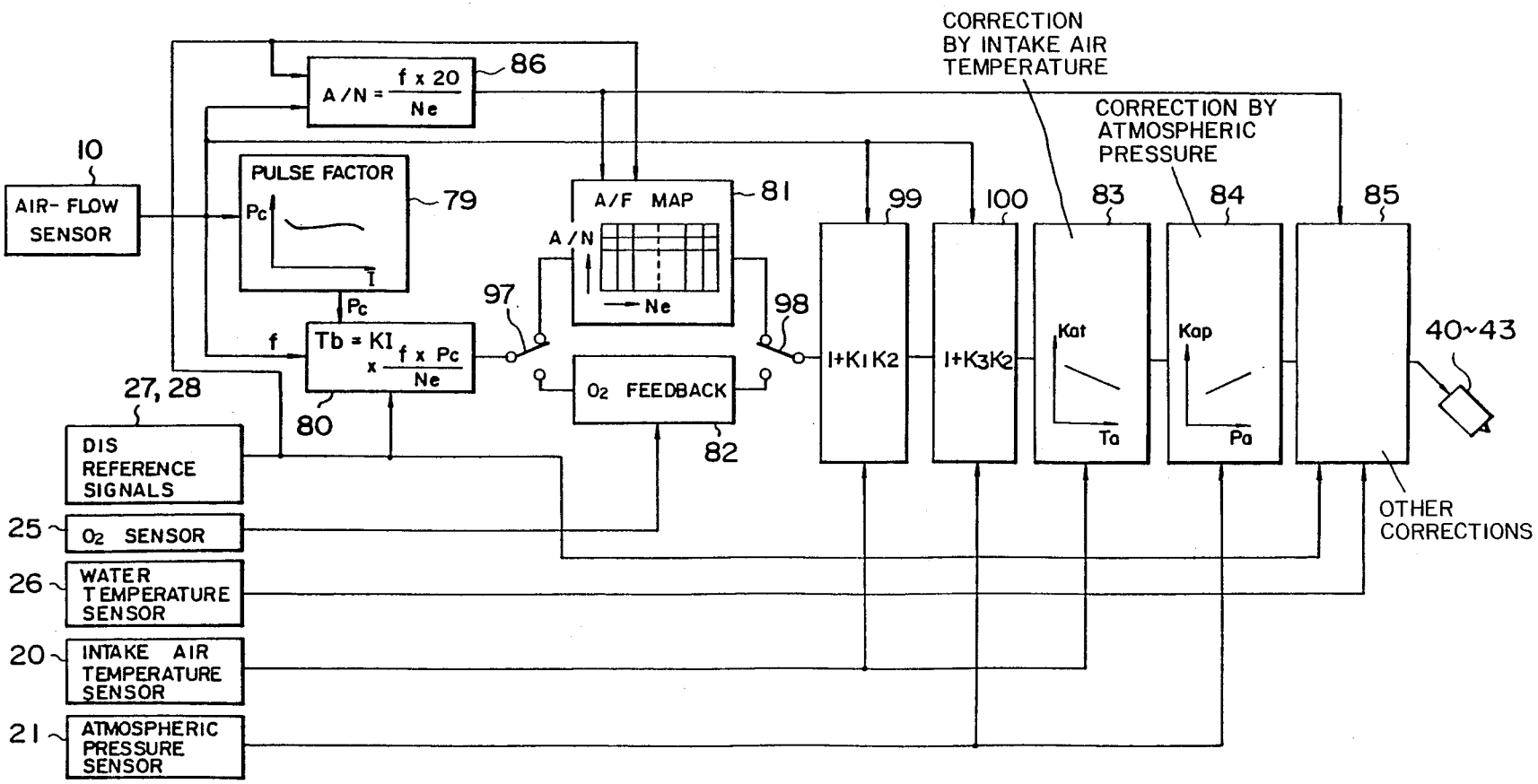
Figure 20:
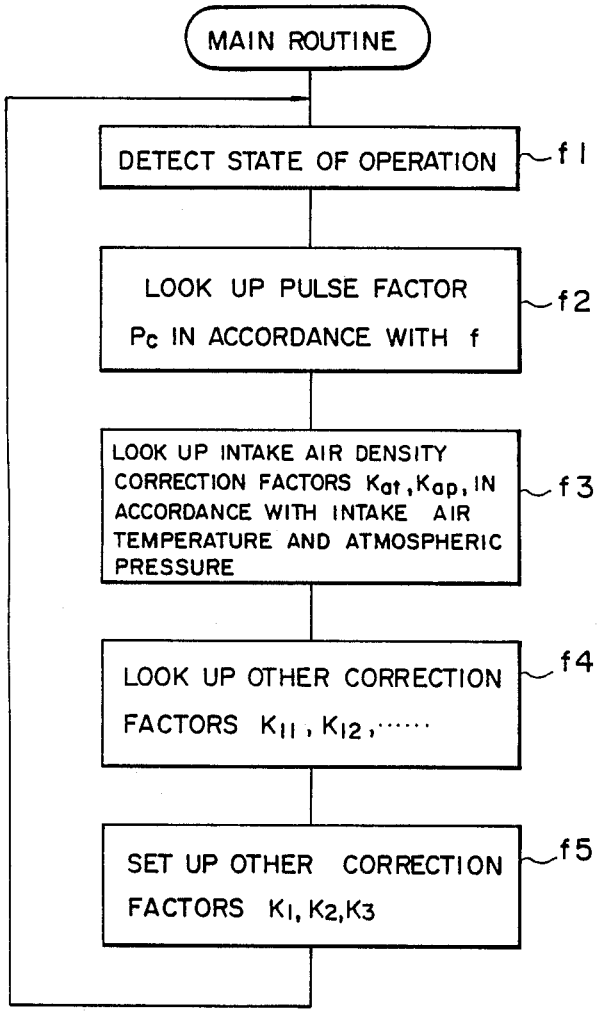

First of all, the block diagram of the fuel control in the third embodiment may be illustrated as shown in FIG. 19. The electric circuit diagram for the fuel control is identical to that of the second embodiment depicted in FIG. 12. As will be understood from these drawings, the output of the air-flow sensor 10 is not subjected to such a frequency correction as applied in the above-described first embodiment before it enters the CPU 19. Namely, the pulse signal from the air-flow sensor 10 is inputted to the CPU 19 without any advance correction in this embodiment. Instead, a correction is performed in accordance with both intake air temperature and atmospheric pressure in the CPU 19 so that the correction of the fuel feed quantity control based on the output of the air-flow sensor 10 is performed in accordance with variations in kinematic viscosity of air by means of software. The correction includes a correction by a change in the intake air temperature $T_a$ and a correction by a change in the atmospheric pressure $P_a$. These corrections are performed by a kinematic viscosity correction means indicated at numerals 99 and 100 in FIG. 19. For the same reasons as mentioned above with respect to the first and second embodiments, this correction by the kinematic viscosity (correction by the volumetric flow rate) is performed only for a lower Strouhal number range (for example, the range lower than 100 Hz in terms of Karman frequency).

The fuel feed quantity control by the third embodiment will hereinafter be described in detail. In the main flow shown in FIG. 20, an operation state is detected (Step fl), a pulse constant $P_c$ is looked up based on Karman frequency information f (Step f2), intake air density correction factors $K_{at}$,$K_{ap}$ are looked up in accordance with intake air temperature $T_a$ and atmospheric pressure $P_a$ (Step f3), other correction factors $K_{11}$,$K_{12}$, . . . . are looked up (Step f4), and correction factors $K_1$,$K_2$,$K_3$ are set by the kinematic viscosity correction means 99,100 (Step f5).

Since the frequency information f used in Step f2 has not been corrected in accordance with a variation in kinematic viscosity unlike the first embodiment described above, it is necessary to perform such a correction upon determination of the quantity of the fuel to be fed. For this purpose, the correction factors $K_1K_2$,$K_3$ are set in Step f5 of FIG. 20 in order to effect a correction by the kinematic viscosity.

Figure 23:
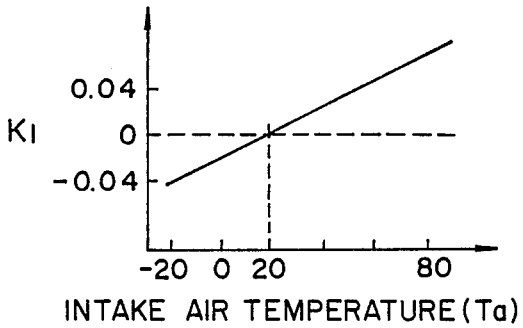
Figure 24:
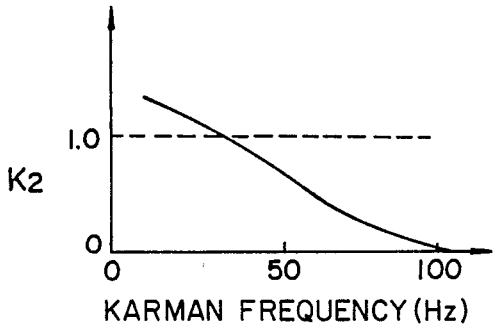
Figure 25:
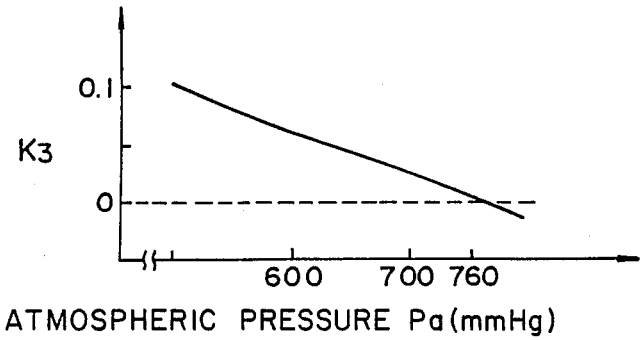

The correction factor $K_1$ relates to the intake air temperature $T_a$ and has such characteristics as shown in FIG. 23. The correction factor $K_2$ is concerned with the Karman frequency f and has such characteristics as depicted in FIG. 24. The correction factor $K_3$ pertains to the atmospheric pressure $P_a$ and has such characteristics as illustrated in FIG. 25. Paying attention to the fact that the output frequency from the air-flow sensor 10 decreases as the intake air temperature $T_a$ increases but increases as the intake air temperature $T_a$ decreases, the characteristics shown in FIG. 23 are of such nature that the above-mentioned tendency of the output frequency from the air-flow sensor 10 may be compensated. In view of the fact that the Strouhal number decreases in the range lower than 100 Hz in terms of Karman frequency but remains substantially constant in the range higher than 100 Hz, the characteristics depicted in FIG. 24 are of such nature that the Strouhal number may be compensated.

In the third embodiment, the kinematic viscosity correction means 99,100 therefore make up the fuel feed quantity correction means which corrects the fuel feed quantity in accordance with the intake air temperature $T_a$, atmospheric pressure $P_a$ and output frequency information from the air-flow sensor 10 so as to correct the fuel feed quantity control, which is in turn performed based on the output of the air-flow sensor, in accordance with changes in kinematic viscosity of the atmospheric air.

Figure 21:
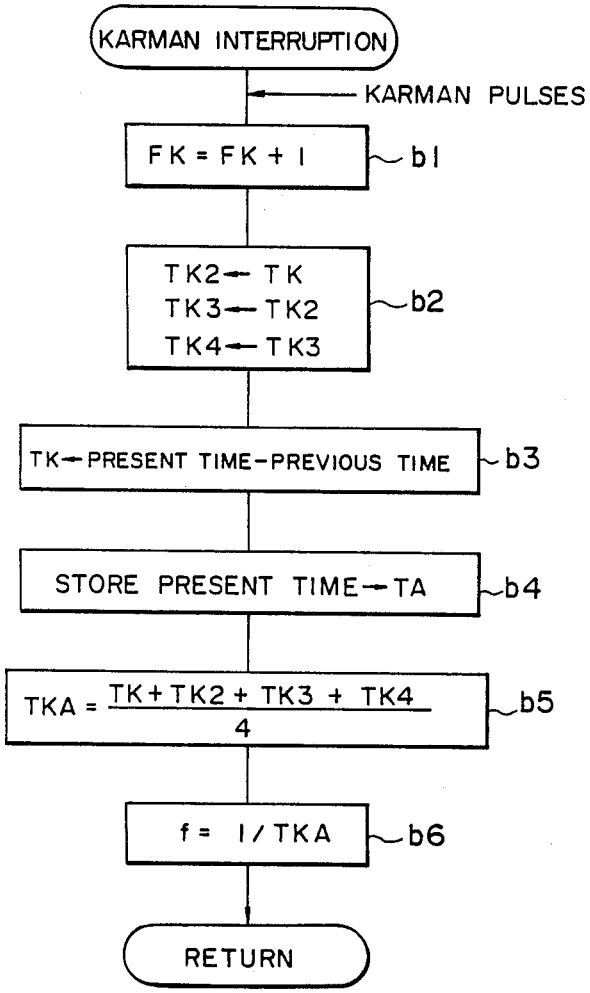

The Karman interruption routine, which is used to determine the Karman frequency f, may be shown as depicted in FIG. 21. Since this routine is the same as the Karman interruption routine depicted in FIG. 6 and described above with respect to the first embodiment, its description is omitted herein and instead, the corresponding steps are identified by the same reference symbols.

Figure 22:
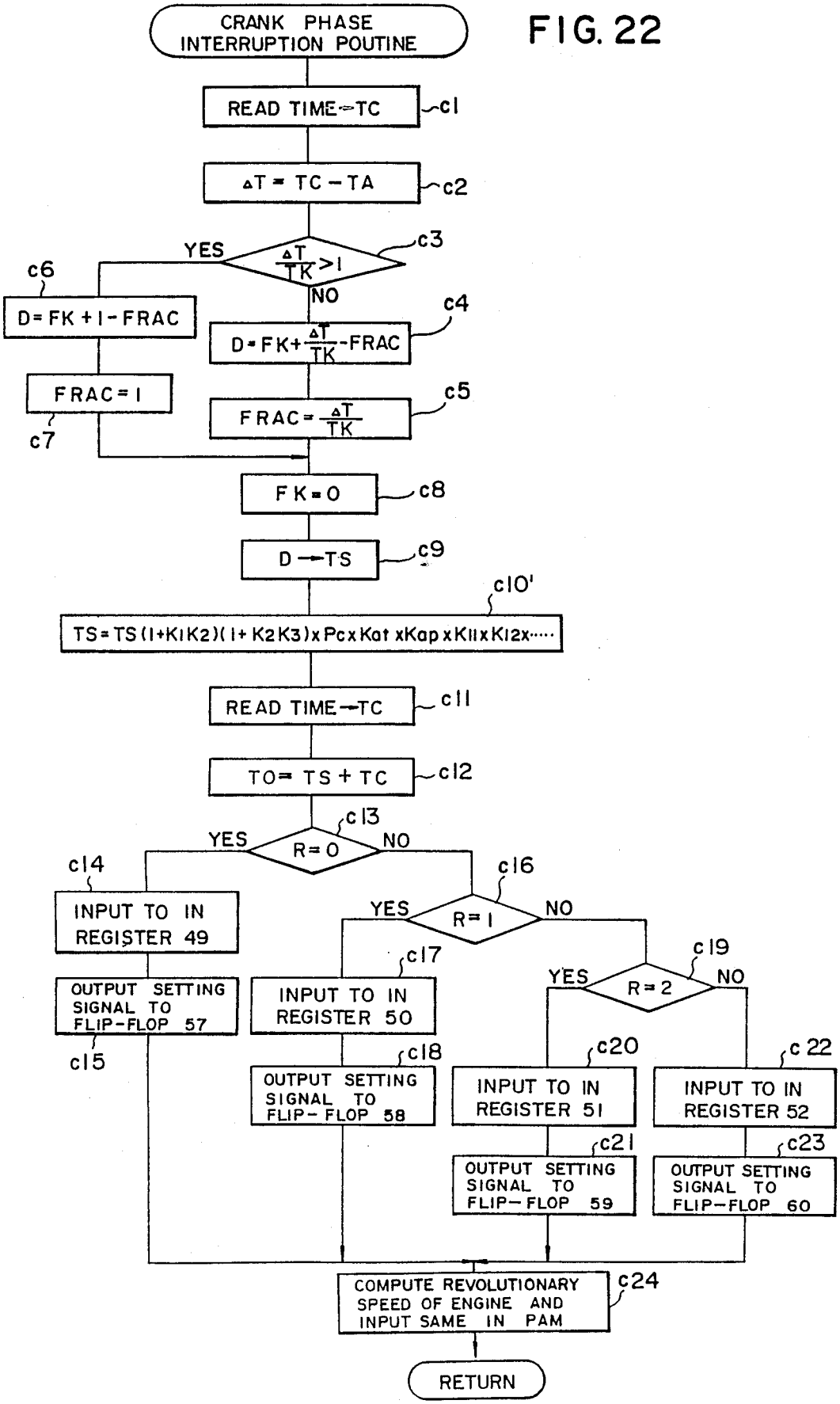

The crank phase interruption routine, which is a specific fuel injection control routine, may be illustrated as shown in FIG. 22. This routine is the same as the crank phase interruption routines depicted in FIGS. 7 and 15 and described above with respect to the first and second embodiments respectively, except for Step c10. The description of the routine will therefore be limited to Step c0' which corresponds to Step c10, and other description is omitted herein and instead, the corresponding steps are identified by the same reference symbols.

Namely, in Step c10' of FIG. 22, the datum of the address TS is multiplied by the various factors obtained in the main routine, $P_c$, $K_1$, $K_2$, $K_3$, $K_{at}$, $K_{ap}$, $K_{11}$, $K_{12}$, . . . . . , in such a way as $TS(1+K_1K_2)(1+K_3K_2)K_{at}\times$-

$K_{ap} \times K_{11} \times K_{12} \times \ldots$. The product is stored again at the address TS. The subsequent processings are identical to those shown in the routines of FIGS. 7 and 15 respectively.

Since the possible reduction of the accuracy of the fuel injection control can be avoided by correcting the output frequency of the air-flow sensor 10 in accordance with variations in kinematic viscosity of air in the manner described above, a precise fuel feed quantity control can be materialized.

A description will next be made of the fuel feed quantity control system of the fourth embodiment of this invention shown in FIGS. 26–29, which is also suitable for use with an engine. In each of the drawings, the same reference symbols as those in FIGS. 1–25 indicate substantially the same elements of structure. Accordingly, the elements of structure common to the first–third embodiments described above are omitted herein.

Figure 26:
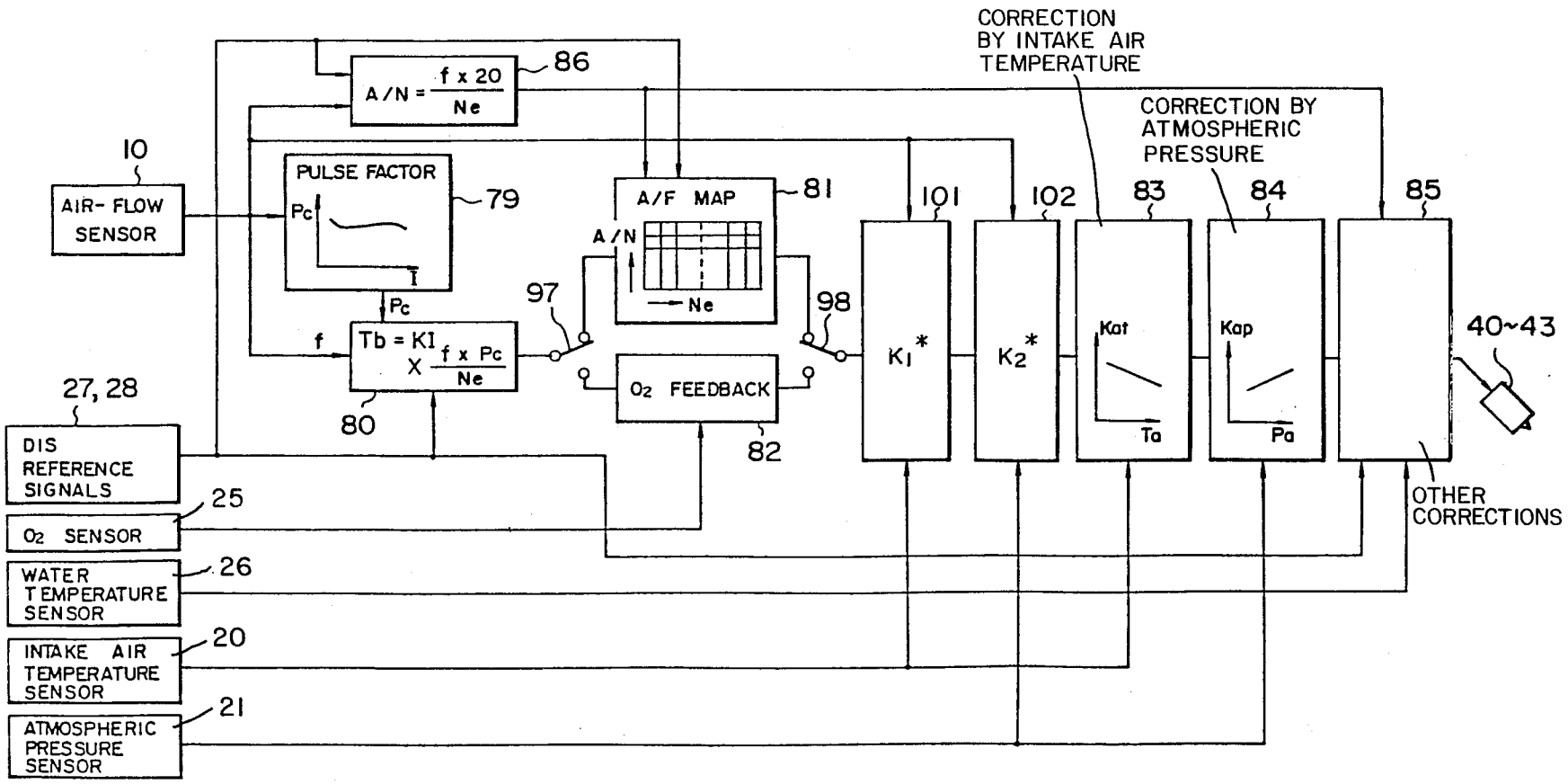
Figure 27:
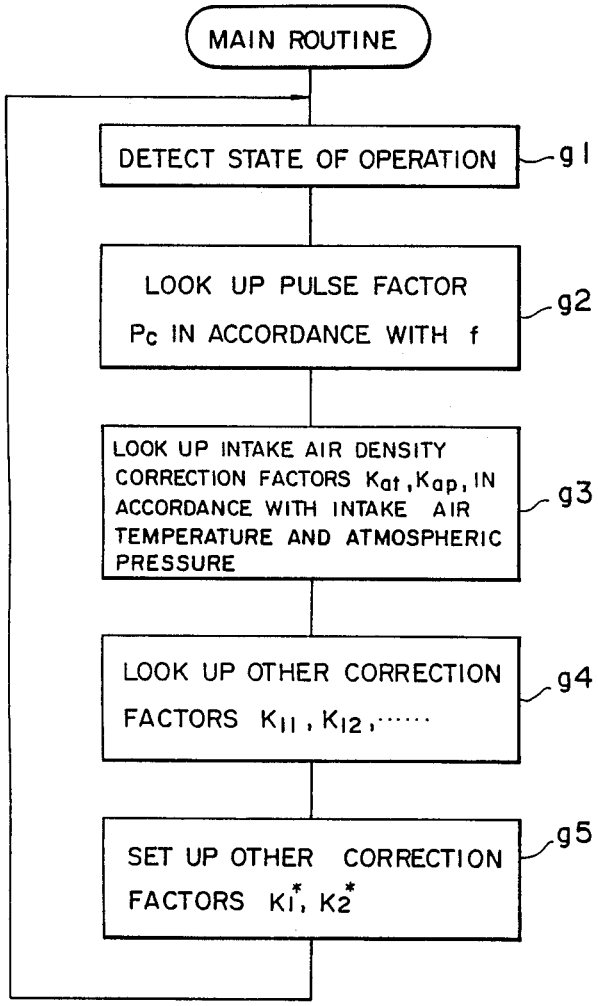

First of all, the fuel control block diagram of the fourth embodiment may be illustrated as shown in FIG. 26. An electric circuit diagram for its fuel control is identical to that of the second embodiment described above, namely, may be illustrated as shown in FIG. 12. As will be appreciated from these drawings, the output of the air-flow sensor 10 is not subjected to such a frequency correction as applied in the above-described first embodiment before it enters the CPU 19. In this embodiment, the pulse signal from the air-flow sensor 10 is inputted to the CPU 19 without any correction. By performing corrections in accordance with the intake air temperature and atmospheric pressure subsequently in the CPU 19, the fuel feed quantity control based on the output of the air flow sensor 10 is corrected in accordance with variations in kinematic viscosity of air by software. The correction include a correction by a variation in the intake air temperature $T_a$ and a correction by a variation in the atmospheric pressure $P_a$. These corrections are performed by a kinematic viscosity correction means indicated at numerals 101 and 102 in FIG. 26. For the same reasons as mentioned above with respect to the first–third embodiments, this correction by the kinematic viscosity (correction by the volumetric flow rate) is performed only for a lower Strouhal number range (for example, the range lower than 100 Hz in terms of Karman frequency).

The fuel feed quantity control by the fourth embodiment will hereinafter be described in detail. In the main flow shown in FIG. 27, an operation state is detected first (Step g1), a pulse constant $P_c$ is looked up based on Karman frequency information f (Step g2), intake air density correction factors $K_{at}$,$K_{ap}$ are looked up in accordance with intake air temperature $T_a$ and atmospheric pressure $P_a$ (Step g3), other correction factors $K_{11}$,$K_{12}$, .... are looked up (Step g4), and correction factors $K_1$*,$K_2$* are set by the kinematic viscosity correction means 101,102 (Step g5).

Since the frequency information f used in Step g2 has not been corrected in accordance with a variation in kinematic viscosity unlike the first embodiment described above, it is necessary to perform such a correction upon determination of the quantity of the fuel to be fed. For this purpose, the correction factors $K_1$*,$K_2$* are set in Step g5 of FIG. 27 in order to effect a correction by the kinematic viscosity.

The correction factor $K_1$* is determined from a two dimensional map of the intake air temperature $T_a$ and Karman frequency f, such as that shown in Table 1. On the other hand, the correction factor $K_2$* is determined by a two dimensional map of the atmospheric pressure $P_a$ and Karman frequency f, such as that illustrated in Table 2.

TABLE 1

| Intake air temp. $T_a$ (°C.) | Correction Factor $K_1$* Map f (Hz) 0 | 20 | 40 | 60 . . . | 100 |
|---|---|---|---|---|---|
| −20 | 0.96 | 0.97 | 0.97 | — | 1.00 |
| 0 | — | — | — | | — |
| 20 | 1.00 | 1.00 | 1.00 | — | 1.00 |
| — | — | — | — | | — |
| — | — | — | — | | 1.00 |
| 80 | 1.09 | 1.08 | 1.07 | — | 1.00 |

TABLE 2

| Atmospheric pressure $P_a$ (mmHg) | Correction Factor $K_2$* Map f (Hz) 0 | 20 | 40 | 60 | . . . | 100 |
|---|---|---|---|---|---|---|
| 760 | 1.00 | 1.00 | 1.00 | 1.00 | . . . | 1.00 |
| 700 | — | — | — | — | . . . | — |
| 650 | 1.05 | 1.04 | 1.03 | 1.02 | . . . | — |
| 600 | — | — | — | — | . . . | — |
| 550 | 1.09 | 1.08 | 1.07 | 1.05 | . . . | 1.00 |
| 500 | — | — | — | — | . . . | 1.00 |
| — | — | — | — | — | . . . | — |

Paying attention to the fact that the output frequency from the air-flow sensor 10 decreases as the intake air temperature $T_a$ increases but increases as the intake air temperature $T_a$ decreases, the characteristics of the map shown in Table 1 are of such nature that the above-mentioned tendency of the output frequency from the air-flow sensor 10 may be compensated. In view of the fact that the output frequency from the air-flow sensor 10 drops as the atmospheric pressure $P_a$ decreases but goes up as the atmospheric pressure $P_a$ increases, the characteristics of the map shown in Table 2 are of such nature that the output frequency of the air-flow sensor 10 may be compensated.

A compensation, which is required in view of the fact that the Strouhal number decreases in the Karman frequency range lower than 100 Hz but remains substantially constant in the Karman frequency range higher than 100 Hz, is included in the maps of Tables 1 and 2.

In the fourth embodiment, the kinematic viscosity correction means 101,102 therefore make up the fuel feed quantity correction means which corrects the fuel feed quantity in accordance with the intake air temperature $T_a$, atmospheric pressure $P_a$ and output frequency information from the air-flow sensor 10 so as to correct the fuel feed quantity control, which is in turn performed based on the output of the air-flow sensor, in accordance with changes in kinematic viscosity of the atmospheric air.

Figure 28:
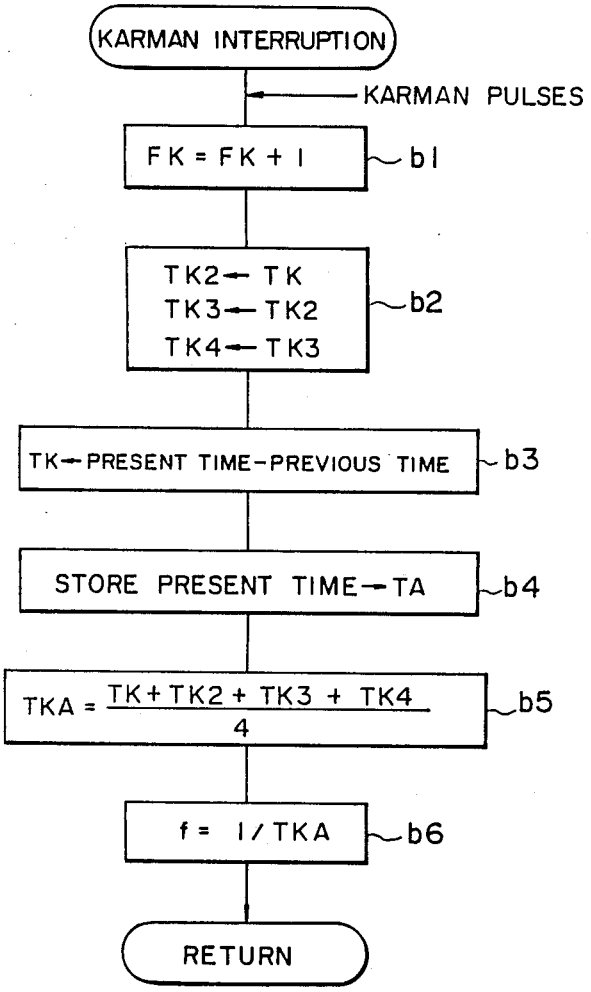

The Karman interruption routine, which is used to determine the Karman frequency f, may be shown as depicted in FIG. 28. Since this routine is the same as the Karman interruption routines depicted in FIG. 6 and FIG. 21 and described above with respect to the first and third embodiments respectively, its description is omitted herein and instead, the corresponding steps are identified by the same reference symbols.

Figure 29:
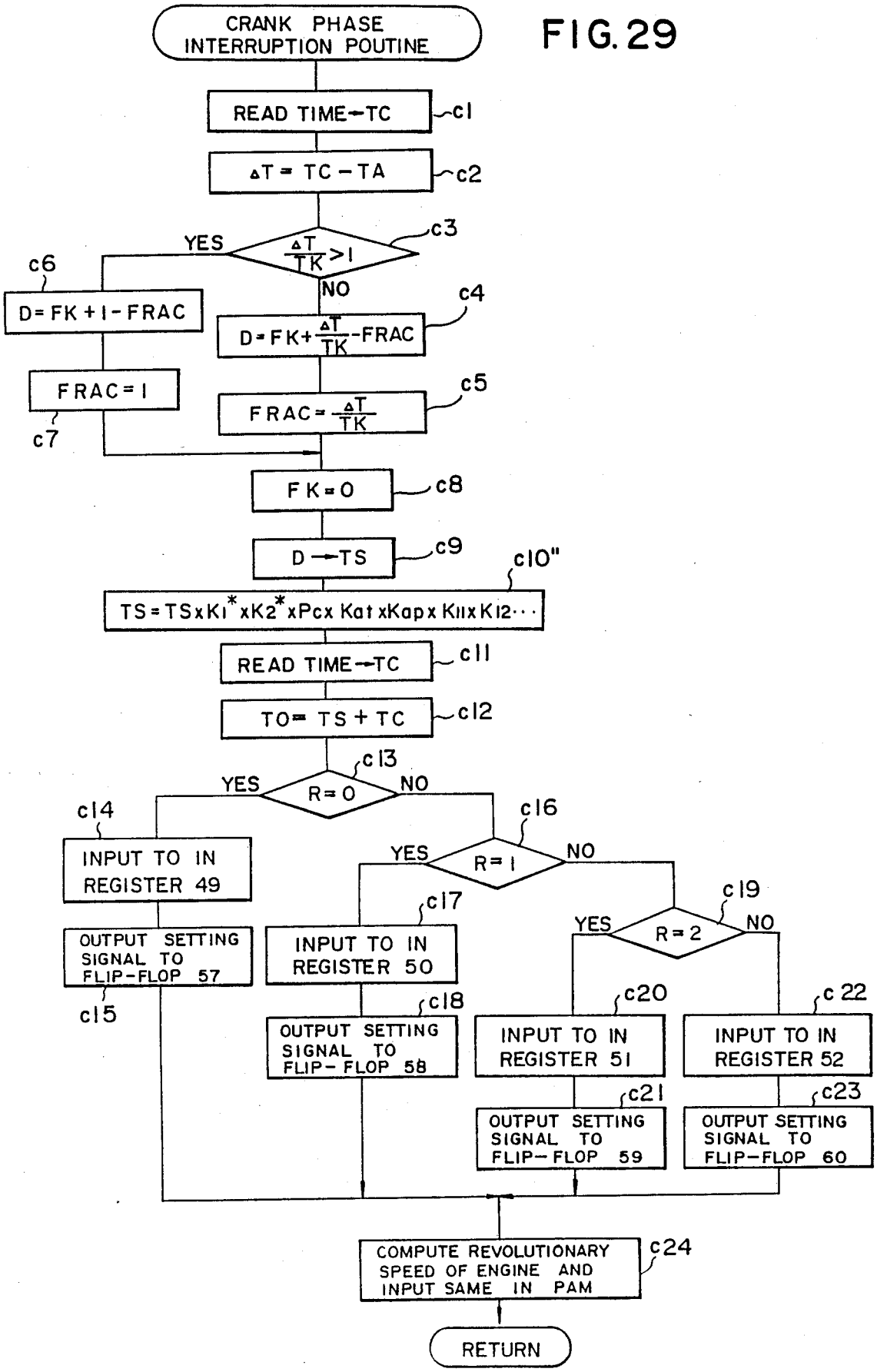

The crank phase interruption routine, which is a specific fuel injection control routine, may be illustrated as shown in FIG. 29. This routine is the same as the crank phase interruption routines depicted in FIGS. 7, 15 and 22 and described above with respect to the first–third embodiments respectively, except for Step c10,c10'. The description of the routine will therefore be limited to Step c10'' which corresponds to Steps c10,c10' and other description is omitted herein and instead, the corresponding steps are identified by the same reference symbols.

Namely, in Step c10'' of FIG. 29, the datum of the address TS is multiplied by the various factors obtained in the main routine, $P_c$, $K_1^*$, $K_2^*$, $K_{at}$, $K_{ap}$, $K_{11}$, $K_{12}$, . . . . . , in such a way as $TS \times K_1^* \times K_2^* \times K_{at} \times K_{ap} \times K_{11} \times K_{12} \times$. . . . The product is stored again at the address TS. The subsequent processings are identical to those shown in the routines of FIGS. 7, 15 and 22 respectively.

Since the possible reduction of the accuracy of the fuel injection control can be avoided by correcting the output frequency of the air-flow sensor 10 in accordance with variations in kinematic viscosity of air in the manner described above, a precise fuel feed quantity control can be materialized.

A description will next be made of the fuel feed quantity control system of the fifth embodiment of this invention shown in FIGS. 30–38, which is also suitable for use with an engine. In each of the drawings, the same reference symbols as those in FIGS. 1–29 indicate substantially the same elements of structure.

FIG. 32 illustrates one example of an intake system of an internal combustion engine to which the system of the fifth embodiment is applied. Designated at numeral 13 in the drawing is the internal combustion engine having a capacity of $V_c$ per stroke. The engine 13 draws air via the air-flow sensor 10 in the form of a Karman vortex flow meter, a throttle valve 14*a*, a surge tank 14*b* and the intake passage 14. A fuel is fed by means of the injectors 40–43.

Here, let's use $V_s$ to represent the capacity from the throttle valve 14*a* to the internal combustion engine 13. Numeral 24 indicates the exhaust passage.

FIGS. 33(*a*)–33(*d*) show the relationship between the quantity of inducted air and a given crank angle, and FIG. 33(*a*) indicates the given crank angle (hereinafter called "SGT") of the internal combustion engine 13.

FIG. 33(*b*) shows the quantity $Q_a$ of air flowing past the air-flow sensor 10, FIG. 33(*c*) the quantity $Q_e$ drawn by the internal combustion engine 13, and FIG. 33(*d*) the output pulse $S_f$ of the air-flow sensor 10.

Further, the period from the (n−2)th rise to the (n−1)th rise of the SGT will be represented by $t_n$. The quantities of inducted air flowing past the air-flow sensor 10 during the period $t_{n-1}$ and $t_n$ will be referred to as $Q_a(n-1)$ and $Q_a(n)$ respectively. The quantities of air inducted by the internal combustion engine 13 during the period $t_{n-1}$ and $t_n$ will be shown by $Q_e(n-1)$ and $Q_e(n)$ respectively.

In addition, average pressures and average temperatures in the surge tank 14*b* during the periods $t_{n-1}$ and $t_n$ will be expressed by $P_s(n-1)$ and $P_s(n)$ and $T_s(n-1)$ and $T_s(n)$ respectively.

For example, $Q_{a(n-1)}$ corresponds to the number of pulses outputted from the air-flow sensor 10 during the period $t_{n-1}$. Assuming that $T_s(n-1)$ is substantially equal to $T_s(n)$ [$T_s(n-1) \simeq T_s(n)$] as the rate of variation of the intake air temperature is small and that the charging efficiency of the internal combustion engine 13 is constant, the following equations can be established.

$$P_s(n-1) \cdot V_c = Q_e(n-1) \cdot R \cdot T_s(n) \quad (3)$$

$$P_s(n) \cdot V_c = Q_e(n) \cdot R \cdot T_s(n) \quad (4)$$

where R is a constant. Representing by $\Delta Q_a(n)$ the quantity of air which remains within the surge tank 14*b* and intake passage 14 during the period $t_n$, $\Delta Q_a(n)$ may be expressed as follows:

$$\begin{aligned} \Delta Q_a(n) &= Q_a(n) - Q_a(n-1) \\ &= V_s \cdot \frac{1}{R \cdot T_s} \times \{(P_s(n) - (P_s(n-1)\} \end{aligned} \quad (5)$$

From Equations (3)–(5), the following equation is then derived.

$$Q_e(n) = \frac{1}{1 + \frac{V_e}{V_s}} \cdot Q_e(n-1) + \left(1 - \frac{1}{1 + \frac{V_e}{V_s}}\right) \cdot Q_a(n) \quad (6)$$

Based on the quantity $Q_a(n)$ of air flowing past the air-flow sensor 10 during the period $t_n$, it is hence possible to calculate the quantity $Q_e(n)$ of air, which is inducted by the internal combustion engine 13 during the same period, in accordance with Equation (6). Introducing $V_c = 0.5$ l and $V_s = 2.5$ l by way of example, $$Q_e(n) = 0.83 \times Q_e(n-1) + 0.17 \times Q_a(n) \quad (7)$$

FIGS. 34(*a*)–34(*d*) illustrate the manner of changes of $Q_a$, $Q_e$ and P when the throttle valve 14*a* is opened. FIG. 34(*a*) relates to the opening rate of the throttle valve 14*a*. FIG. 34(*b*) is concerned with the quantity $Q_a$ of air inducted past the air-flow sensor 10. It is appreciated that the quantity $Q_a$ increases abruptly as soon as the throttle valve 14*a* is opened. FIG. 34(*c*) relates to the quantity $Q_e$ of air corrected by Equation (6), which is to be inducted by the internal combustion engine 13. FIG 34(*d*) relates to the pressure P of the surge tank 14*b*.

Figure 30:
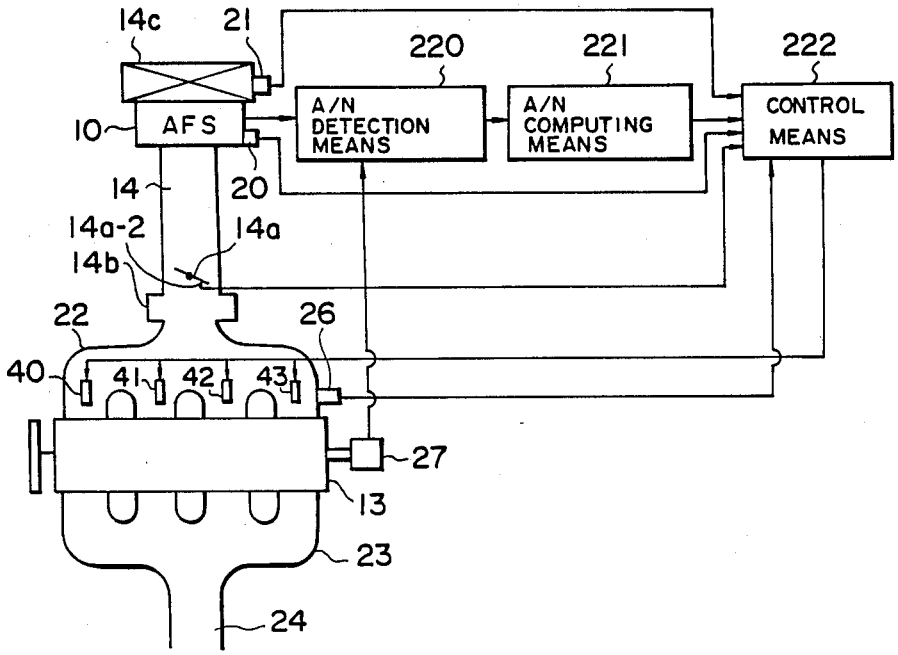

FIG. 30 shows the construction of the control system according to the fifth embodiment. Numeral 14*c* indicates the air cleaner arranged on the upstream side of the air-flow sensor 10. Arranged in the proximity of the air cleaner 14*c* is the atmospheric pressure sensor 21 of the semiconductor type which serves to detect the atmospheric pressure. In accordance with the quantity of air inducted into the internal combustion engine 13, the air-flow sensor 10 outputs such pulses as shown in FIG. 33(*d*). The intake air temperature sensor 20 housed within the air-flow sensor 10 is constructed of a thermistor, while the crank angle sensor 27 outputs such pulses as shown in FIG. 33(*a*) with every revolution of the internal combustion engine 13 (the period from the rise of one pulse to that of the next pulse corresponds, for example, to 180° in terms of crank angle).

Designated at numeral 220 is an A/N (quantity of air inducted per every revolution of the engine) detection means. Based on the output of the air-flow sensor 10 and that of the crank angle sensor 27, the A/N detection means 220 calculates the number of pulses outputted from the air-flow sensor 10 over a prescribed crank angle of the internal combustion engine 13, thereby detecting the A/N.

Numeral 221 indicates an A/N computing means, which performs a calculation similar to Equation (7) on the basis of the output of the A/N detection means so as to calculate the number of pulses equivalent to an output of the air-flow sensor 10 corresponding to the quantity of air which the internal combustion engine 13 is believed to draw.

Relying upon the output of the A/N computing means 221, the output of the water temperature sensor (for example, thermistor) adapted to detect the temperature of the coolant water of the internal combustion engine 13, the output of the intake air temperature sensor 20, the output of the atmospheric pressure sensor 21 and the output of the idle switch **14*a*-2 adapted to detect the state of idling, the control means 222 controls the actuation time of the injectors 40–43 in accordance with the quantity of air which is inducted into the internal combustion engine 13. As a consequence, the control means 222 controls the quantity of the fuel to be fed to the internal combustion engine 13. Incidentally, numerals 22 and 23 in FIG. 30** indicate the intake manifold and exhaust manifold respectively.

Figure 31:
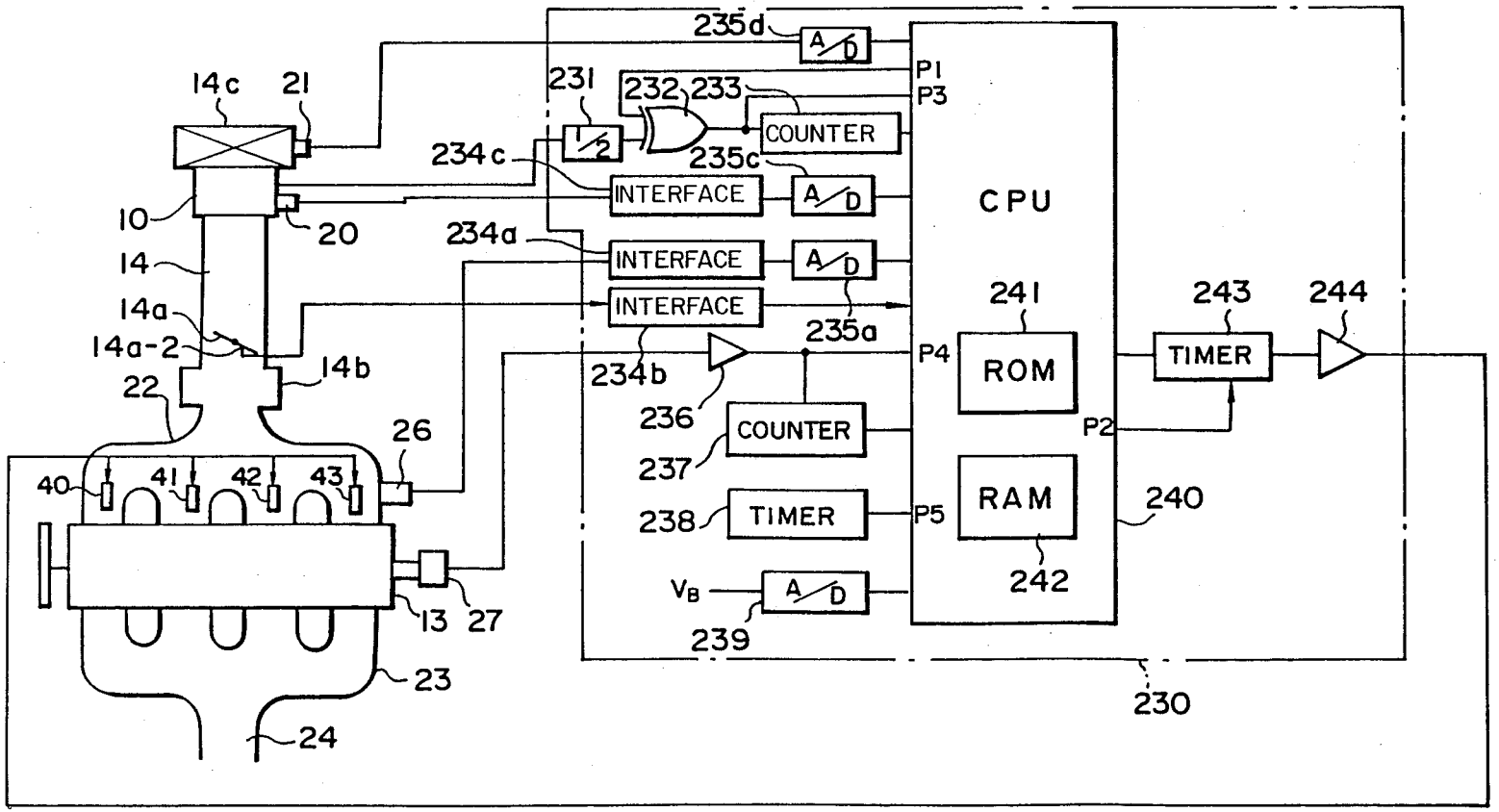
Figure 34A:
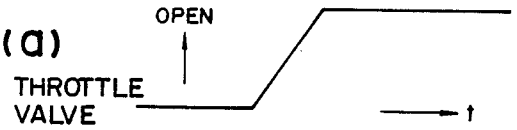
Figure 34B:
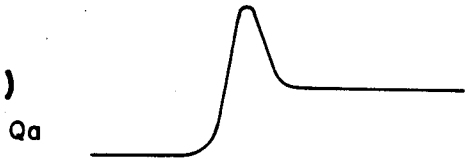
Figure 34C:
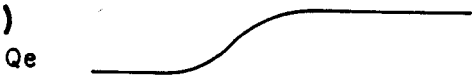
Figure 34D:
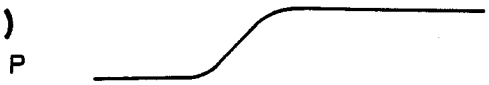

FIG. 31 illustrates more specific construction of the fifth embodiment. Designated at numeral 230 is a control unit which receives as input signals the outputs of the air-flow sensor 10, water temperature sensor 26, idle switch **14*a*-2 and crank angle sensor 27 and controls the four injectors 40–43 provided with the individual cylinders of the internal combustion engine 13. This control unit 230 corresponds to the A/N detection means 220 - control means 222 in FIG. 30. As a matter of fact, the control unit 230 is constructed of a microcomputer (hereinafter abbreviated as "CPU") 240 having an ROM 241 and an RAM 242**.

Numeral 231 indicates a ½ frequency divider connected to the output terminal of the air-flow sensor 10, while numeral 232 designates an exclusive-OR gate which receives at one of its input terminals the output of the ½ frequency divider 231 and is connected at the other input terminal to an input terminal P1 of the CPU 240. The output terminal of the gate 232 is connected to both a counter 233 and an input terminal P3 of the CPU 240.

The output of the water temperature sensor 26 is inputted to a A/D (analog-to-digital) converter **235*a* via an interface 234*a*. The output of the A/D converter 235*a* is in turn delivered to the CPU 240**.

Between the idle switch **14*a*-2 and CPU 240, an interface 234*b* is connected. The output of the intake air temperature sensor 20 is inputted to an A/D converter 235*c* by way of an interface 234*c*. The output of the A/D converter 235*c* is in turn sent out to the CPU 240**.

The output of the atmospheric pressure sensor 21 is delivered to an A/D converter **235*d*, and the output of the A/D converter 235*d* is in turn inputted to the CPU 240**.

A waveform shaper 236 is inputted with the output of the crank angle sensor 27. The output of the waveform sensor 236 is in turn outputted to an interruption input terminal P4 of the CPU 240 and a counter 237.

A timer 238 is connected to an interruption input terminal P5 of the CPU 240. An A/D converter 239 performs A/D conversion of the voltage $V_B$ of an unillustrated battery and then outputs the thus-converted voltage to the CPU 240.

A timer 243 is provided between the CPU 240 and an actuator 244. The output terminal of the actuator 244 is connected to each of the injectors 40–43.

The operation of the above construction will next be described. The output of the air-flow sensor 10 is divided by the ½ frequency divider 231, and is then inputted to the counter 233 by way of the exclusive-OR gate 232 which is controlled by the CPU 240. The counter 233 measures the period between the fall edges of adjacent outputs from the exclusive-OR gate 232.

The CPU 240 is inputted at the interruption input terminal P3 with each fall of the exclusive-OR gate 232, whereby an interrupt processing is performed with every output of pulse from the air-flow sensor 10 or with every ½ division of the pulse so as to measure the cycle of the counter 233.

On the other hand, the outputs of the water temperature sensor 26 and intake air temperature sensor 20 are converted into their corresponding voltages by the interfaces **234*a*,234*c* respectively, followed by further conversions by the A/D converters 235*a*,235*c*. The output of the atmospheric sensor 21 is converted into a digital value at a desired time interval by the A/D converter 235*d* and is then inputted to the CPU 240**.

The output of the crank angle sensor 27 is inputted to the interruption input terminal P4 of the CPU 240 and to the counter 237 by way of the waveform shaper 236.

In addition, the output of the idle switch **14*b*-2 is inputted to the CPU 240 via the interface 234*b***.

The CPU 240 performs an interrupt processing with every rise of the crank angle sensor 27, and detects the cycle of adjacent rises of the crank angle sensor 27 from the output of the counter 237.

The timer 238 generates interrupt signals at a predetermined interval to the interrupt input P5 of the CPU 240.

Further, the A/D converter 239 performs A/D conversion of the voltage $V_B$ of the unillustrated battery. The CPU 240 receives at a prescribed interval data of the battery voltage.

The timer 243 is preset by the CPU 240, and is triggered by an output from the output port P2 of the CPU 240 so as to output pulses with a predetermined width. The output of the timer 243 actuates the injectors 40–43 by way of the actuator 244.

The operation of the CPU 240 will next be described with reference to the flow charts of FIGS. 35, 36 and 37. First of all, FIG. 35 indicates the main program of the CPU 240. When a resetting signal is inputted to the CPU 240, the RAM 242, input and output ports, etc. are initialized in Step h1. In Steps h2–h5, the water temperature, intake air temperature, atmospheric pressure and battery voltages are A/D-converted respectively and are then stored in addresses WT, AT, AP and $V_B$ of the RAM 242.

In Step h6, a calculation of 30/TR is performed based on the cycle of the crank angle sensor 27 to calculate the revolutionary speed $N_e$ of the engine.

In Step h7, a calculation of $AN \cdot T_R$ is performed on the basis of load datum AN (which indicates the same information as the A/N described above) and cycle $T_R$ which will be described subsequently, thereby calculating the average output frequency $F_a$ of the air-flow sensor 10.

In Step h8, linear interpolation is performed by a basic actuation time conversion factor map $f_1$ set relative to the frequency $F_a$ as shown in Table 4, so that the basic actuation time conversion factor $K_p$ is calculated.

TABLE 3

| Map v | | | | |
|---|---|---|---|---|
| Intake air temperature | $t_1$ | $t_2$ | $t_3$ | . . . |
| Kinematic viscosity coefficient | $M_1$ | $M_2$ | $M_3$ | . . . |

TABLE 4

| Map $f_1$ | | | | |
|---|---|---|---|---|
| Air-flow sensor output, f | $F_{a1}$ | $F_{a2}$ | $F_{a3}$ | ... |
| Factor | $K_{p1}$ | $K_{p2}$ | $K_{p3}$ | ... |

TABLE 5

| Map h | | | | |
|---|---|---|---|---|
| | $F_a$ | | | |
| $\nu$ | $F_{a1}$ | $F_{a2}$ | $F_{a3}$ | ... |
| $\nu_1$ | $K_{11}$ | $K_{12}$ | $K_{13}$ | ... |
| $\nu_2$ | $K_{21}$ | $K_{22}$ | $K_{23}$ | ... |
| $\nu_3$ | $K_{31}$ | $K_{32}$ | $K_{33}$ | ... |
| — | — | — | — | |
| — | — | — | — | |
| — | — | — | — | |
| — | — | — | — | |

Figure 44:
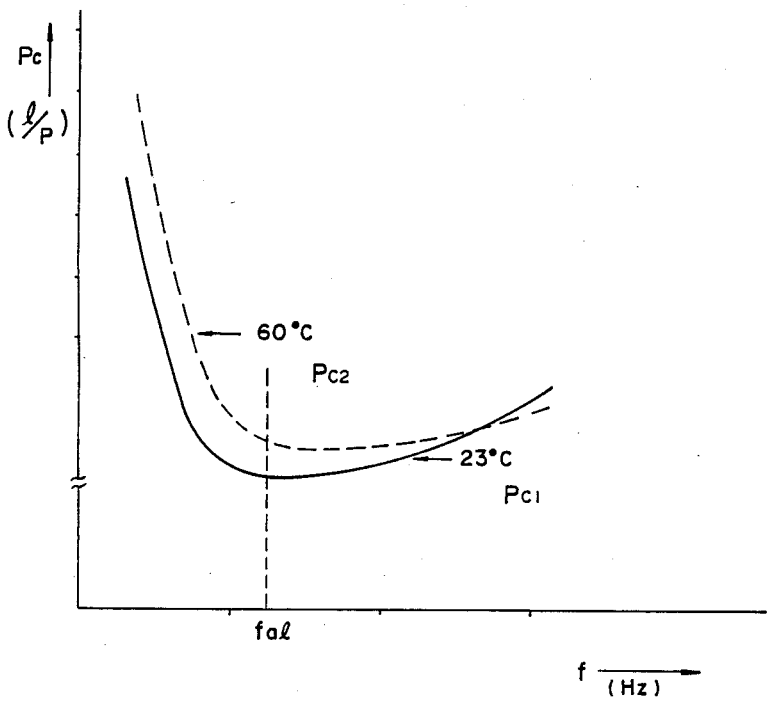
FIG. 44 is a characteristic diagram of the pulse constant of the air-flow sensor of FIG. 40.

The map $f_1$ of Table 4 contains values obtained by multiplying with a constant the pulse constants $P_{cl}$ for the standard state of the intake air temperature of 23° C. and atmospheric pressure of 760 mmHg illustrated in FIG. 44.

When the above-described output frequency is found to be smaller than $F_{au}$ in Step h9, corrections of Step h10 and the subsequent steps are performed. When it is found to be greater than $F_{au}$, $K_p$ is stored at the address $K_{pl}$ in Step 14, and the processings of Step h12 and the subsequent step are then performed.

The kinematic viscosity coefficient $\nu$ is calculated in Step h10. This coefficient $\nu$ is calculated by setting the $T_a$ -related term in Equation (8), which will be given subsequently, in accordance with a coefficient-intake air temperature map such as that shown in Table 1 and then approximating the result in accordance with $v_{(AT)} \times C/BP$, where $v_{(AT)}$ is a factor obtained by interpolating the map v with the intake air temperature AT, C is a constant and AP is a value obtained by subjecting the atmospheric pressure to A/D conversion.

$$\nu = \frac{\dfrac{6.68 \times 10^{-4}}{380 + Ta} \times \sqrt{\left(\dfrac{273 + Ta}{273}\right)^3}}{\dfrac{36 \times (Pa - 0.378 \times Ha/100 \times Pw)}{(273 + Ta) \times 760}} \quad (8)$$

where $T_a$: intake air temperature (° C.)

$P_a$: atmospheric pressure (mmHg)

$H_a$: humidity (%)

$P_w$: water vapor pressure

In Step h11, the above factor $K_p$ is corrected by a correction factor $h(F_a,\nu)$ which is determined by the intake air temperature and atmospheric pressure, namely, by operation parameters of the internal combustion engine, whereby changes in characteristics caused by a variation of the kinematic viscosity coefficient of the air-flow sensor 10 are corrected and stored as $K_{pl}$.

The factor $h(F_a,\nu)$ is a map, in which factors $K_{ij}$ are set relative to output frequencies of the air-flow sensor 10 and kinematic viscosity coefficients as shown in Table 5. As the factors $K_{ij}$, ratios of the pulse constant $P_{c1}$ to the pulse constant $P_{c2}$ ($P_{c2}/P_{c1}$) shown in FIG. 44 may be set relative to the above coefficients $\nu_i$ and frequencies $F_{aj}$ for the intake air temperature of 60° C.

In Step h12, a correction factor is calculated from a map $f_2$ on the basis of the water temperature datum WT, so that the conversion factor $K_{pl}$ is corrected and then stored as an actuation time correction conversion coefficient $K_1$ in the RAM 242.

In Step h13, a data table $f_3$ which has been stored beforehand in the ROM 241 is mapped based on the battery voltage datum $V_B$ so as to calculate a dead time $T_D$. The dead time $T_D$ is then stored in the RAM 242. Subsequent to the processing in Step h13, the processing of Step h13 is repeated again.

Figure 36:
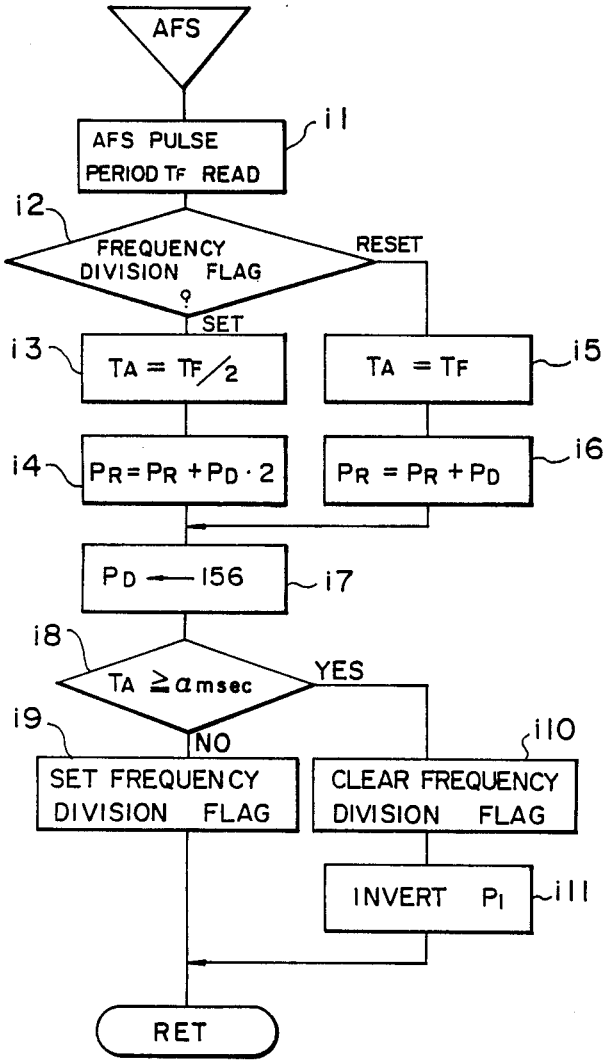

FIG. 36 illustrates an interrupt processing for an interruption input to the terminal P3, namely, an output signal from the air-flow sensor 10. In Step il, the frequency $T_F$ of the output of the counter 233 is detected to clear the counter 233. This frequency $T_F$ is the interval between adjacent rises of the exclusive-OR gate 232.

When the setting of a frequency division flag in the RAM 242 is confirmed in Step i2, the routine advances to Step i3 where the frequency $T_F$ is divided into equal halves and is then stored as an output pulse cycle $T_A$ of the air-flow sensor 10 in the RAM 242.

In Step i4, a datum which has been obtained by doubling the remaining pulse datum $P_D$ is then added to the cumulative pulse datum $P_R$ so as to obtain a new cumulative pulse datum $P_R$. This cumulative pulse datum $P_R$ is the sum of pulses outputted from the air-flow sensor 10 between the rises of adjacent outputs from the crank angle sensor 27. For the convenience of the processing, each pulse of the air-flow sensor 10 is multiplied by 156 to provide the cumulative pulse datum $P_R$.

When the frequency division flag is found to have been reset in Step i2, the cycle $T_F$ is stored as an output pulse cycle $T_A$ in the RAM 242 in Step i5, and in Step i6, the remaining pulse datum $P_D$ is added to the cumulative pulse datum $P_R$.

In Step i7, 156 is set as the remaining pulse datum $P_D$. When $T_A \geqq 2$ msec is found in Step i8 where the frequency division flag has been reset or $T_A \geqq 4$ msec is confirmed in Step i8 where the frequency division flag has been set, the routine advances to Step i10. Otherwise, the routine advances to Step i9.

The frequency division flag is set in Step i9, while the frequency division flag is cleared to reverse P1 in Step ill.

In the case of the processing in Step i9, signals are inputted to the interruption input terminal P3 at a timing of one half of the timing of pulses outputted from the air-flow sensor 10. When the processing of Step i10 is performed, a signal is inputted to the interruption input terminal P3 with every output of a pulse from the air-flow sensor 10. After the processing in the step i9 or i11, the interrupt processing is completed.

Figure 37A:
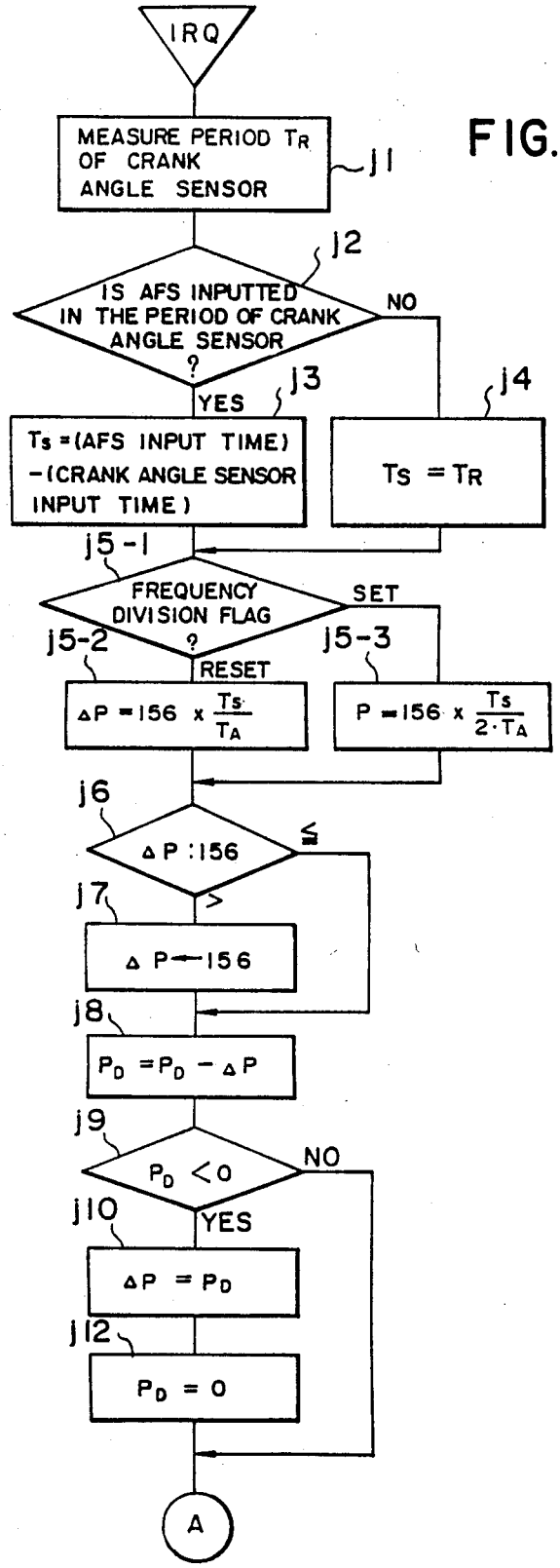
Figure 37:
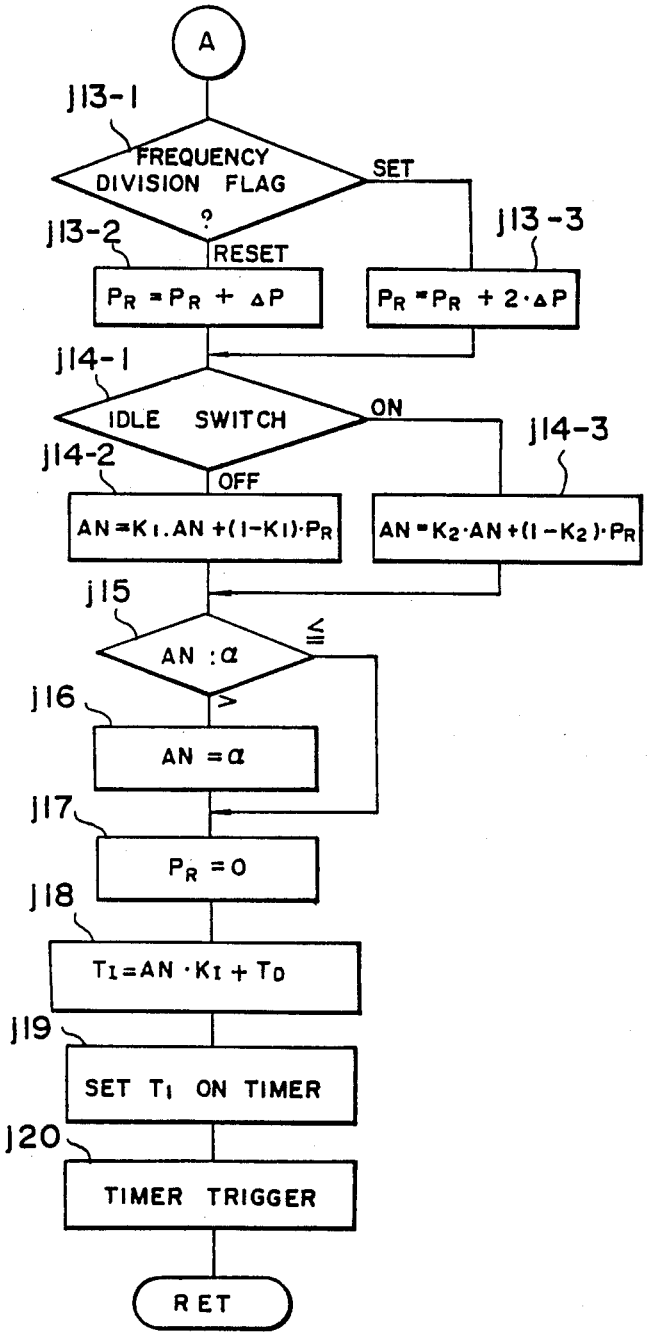

FIGS. 37(*a*) and 37(*b*) illustrate interrupt processings when an interruption signal has occurred at the interruption input terminal P4 of the CPU 240 due to an output from the crank angle sensor 27. This interrupt processing is divided in two drawings, i.e., FIGS. 37(*a*) and 37(*b*) for the convenience of its illustration on a single drawing sheet. Thus, Ⓐ of FIG. 37(*a*) continues to Ⓐ of FIG. 37(*b*).

In Step j1 of FIG. 37(*a*), the interval between adjacent rises of the crank angle sensor 27 is read in by the counter 237, and is stored as a period $T_R$ in the RAM 242 so as to clear the counter 237.

When an output pulse of the air-flow sensor 10 is found within the period $T_R$ in Step j2, the time difference between the time $t_{01}$ of the output pulse of the air-flow sensor 10 immediately before the processing and the present interruption time $t_{02}$ of the crank angle sensor 27, i.e., $\Delta t = t_{02} - t_{01}$ is calculated. The time difference is used as the period $T_s$. When no output pulse of the air-flow sensor 10 is found within the period $T_R$, the period $T_R$ is stored as the period $T_s$ in Step j4.

It is judged in Step j5−1 whether the frequency division flag has been set or not. When the frequency division flag is found to have been reset, the time difference $\Delta t$ is converted into its corresponding output pulse datum $\Delta P$ of the air-flow sensor 10 by a calculation of $156 \times T_s/T_A$ in Step j5−2. When the frequency division flag is found to have been set, the time difference $\Delta t$ is converted into its corresponding output pulse datum $\Delta P$ of the air-flow sensor 10 by a calculation of $156 \times T_s/2T_A$ in Step j5−3.

Namely, the pulse datum $\Delta P$ is calculated by assuming that the previous cycle of pulses outputted from the air-flow sensor 10 is identical to the present cycle of pulses outputted from the air-flow sensor 10.

When the pulse datum $\Delta P$ is found to be smaller than 156 in Step j6, the routine advances to Step j8. When it is found to be greater than 156, the routine advances to Step j7 so as to clip $\Delta P$ for 156.

In Step j8, the pulse datum $\Delta P$ is subtracted from the remaining pulse datum $P_D$ to obtain a new remaining pulse datum $\Delta P$.

When the remaining pulse datum $P_D$ is found to be positive in Step j9, the routine advances to Step j13−1 of FIG. 37(*b*). Otherwise, the calculated value of the pulse datum $\Delta P$ is unduly greater than the output pulse of the air-flow sensor 10. Accordingly, the output pulse datum $\Delta P$ is rendered equal to $P_D$ in Step j10 and the remaining pulse datum $P_D$ is reset to zero in Step j12.

It is judged in Step j13−1 whether the frequency division flag has been set or not. When the frequency division flag is found to have been reset, the pulse datum $\Delta P$ is added to the cumulative pulse datum $P_R$ in Step j13−2. When the frequency division flag is found to have been set, $2 \cdot \Delta P$ is added to $P_R$ in Step j13—3 to obtain a new cumulative pulse datum $P_R$.

This datum $P_R$ is equivalent to the number of pulses which are believed to have been outputted by the air-flow sensor 10 between the rises of adjacent signals outputted this time from the crank angle sensor 27.

A calculation similar to Equation (7) is performed in Step j14. When the idle switch 14*a*−2 is found to be "ON" in Step j14−1 from the load datum AN and cumulative pulse datum $P_R$ calculated before the previous rise of the crank angle sensor 27, the operation is judged to be in an idling state in Step j14−3 so that a calculation of $AN = K_2 \cdot AN + (1 - K_2)$ is performed. When the idle switch 14*a*−2 is found to be "OFF" in Step j14−1, a calculation of $AN + (1 - K_1)P_R$ is performed ($K_1 > K_2$). Results are then employed as a new load datum AN for the present time.

When the load datum AN is found to be greater than a predetermined value $\alpha$ in Step j15, the load datum AN is clipped for $\alpha$ in Step j16 so as to prevent the load datum AN from becoming unduly greater than the actual value even while the throttle valve 14*a* is opened fully.

The cumulative pulse datum $P_R$ is cleared in Step j17. In Step 18, the calculation of an actuation time datum $T_1 = AN \cdot K_1 + T_D$ is performed on the basis of the load datum AN, actuation time conversion factor $K_1$ and dead time $T_D$. The actuation time datum $T_1$ is set on the timer 243 in Step j19 and the timer 243 is triggered in Step j20, whereby the four injectors 40–43 are actuated simultaneously responsive to the datum $T_1$ and the interrupt processing has been completed.

Figure 35:
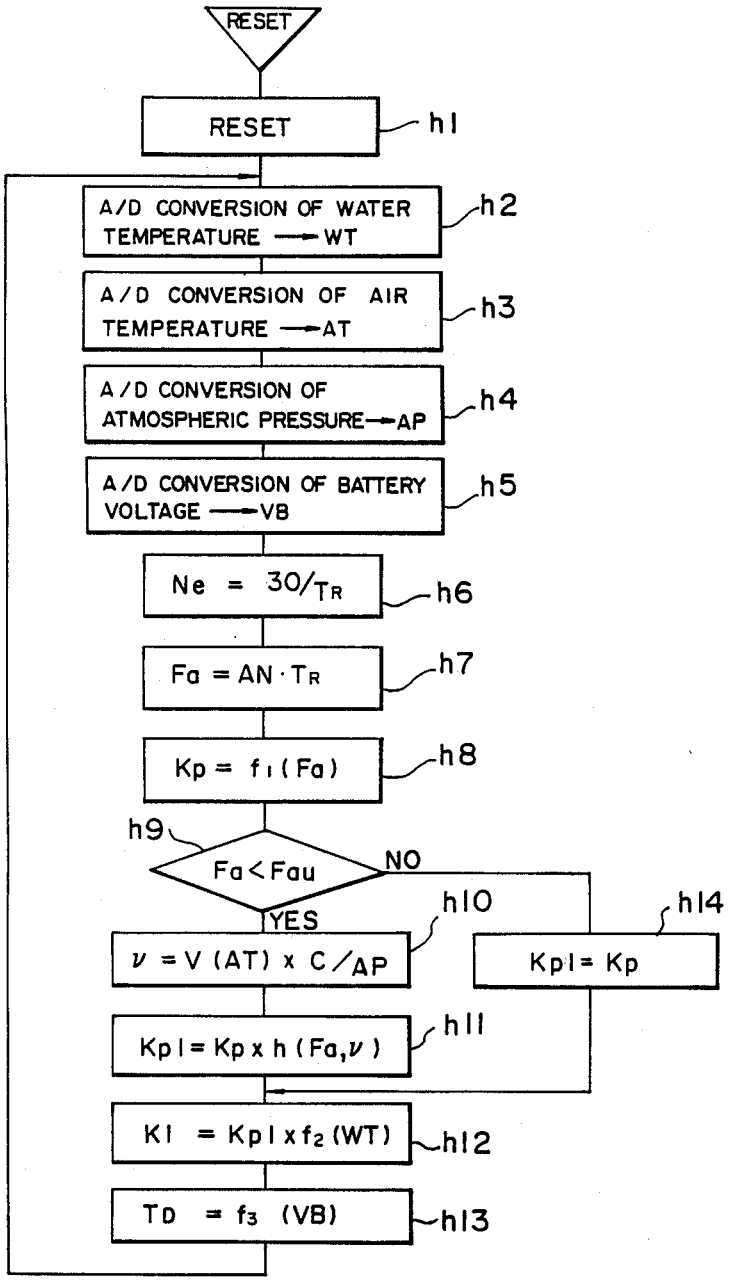
Figures 38A, 38B, 38C, 38D:
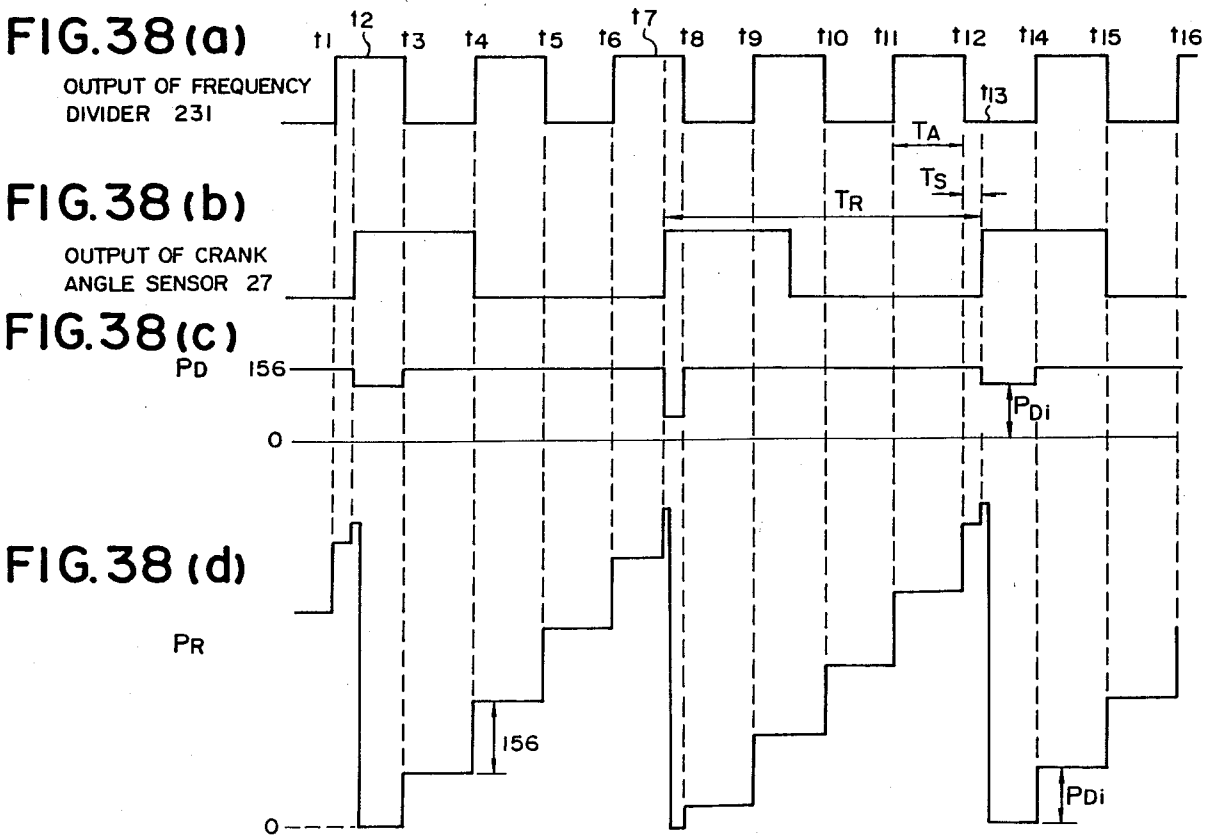

FIGS. 38(*a*) through 38(*d*) illustrate timings upon clearing the frequency division flag in the processings of FIGS. 35, 36, 37(*a*) and 37(*b*). FIG. 38(*a*) relates to the output of the ½ frequency divider 231, while FIG. 38(*b*) is concerned with the output of the crank angle sensor 27.

FIG. 38(*c*) shows the remaining pulse datum $P_D$. The remaining pulse datum $P_D$ is set for 156 with every rise and fall of the frequency divider 231 (with the rise of every pulse outputted from the air-flow sensor 10), but changed, for example, to the calculation result of $P_{D1} = P_D - 156 \times T_s/T_A$ with every rise of the crank angle sensor 27 (this corresponds to the processings of Steps j5–j12).

FIG. 38(*d*) illustrates variations of he cumulative pulse datum $P_R$. It is envisaged that the remaining datum $P_D$ is added with the rise or fall of every output of the frequency divider 231.

As has been described above, the output of the A/N detection means 220 is corrected in the fifth embodiment in accordance with such a factor as shown in FIG. 44, which factor depends on the output of the air-flow sensor 10. It is hence possible to control the fuel feed quantity precisely on the basis of the quantity of inducted air.

Furthermore, the quantity of the fuel to be fed is calculated by detecting the quantity of air inducted per stroke of the engine and then smoothing it in accordance with Equation (6), thereby making it possible to control the air/fuel ratio suitably even in a transition period.

Although the factor $K_p$ is corrected based on one of the factors of the map h in the fifth embodiment, it is also possible to set actuation time conversion factors relative to individual kinematic viscosity coefficients v and output frequencies of the air-flow sensor in the map h and to calculate an actuation time conversion coefficient for given intake air temperature and atmospheric pressure directly from the map h. Owing to the limitation to the range of frequencies to be corrected, it is feasible to reduce the memory capacity required for the correction.

Figure 39:
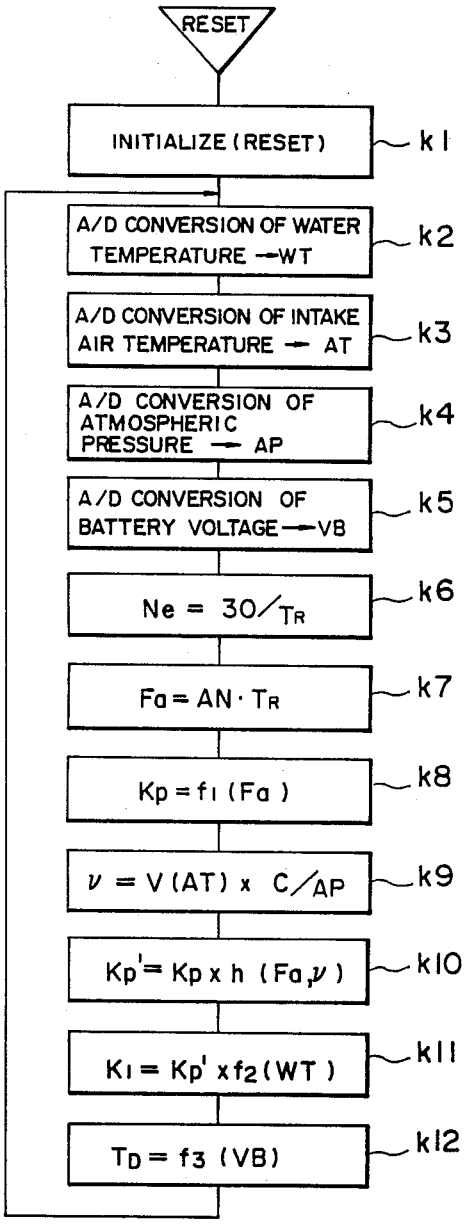
FIG. 39 is a flow chart indicating one operation of a fuel feed quantity control system according to a sixth embodiment of this invention, which is suitable for use with an engine.
Figure 40:
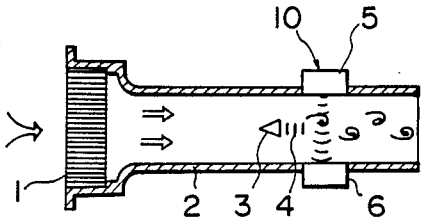
FIG. 40 PRIOR ART
Figure 41:
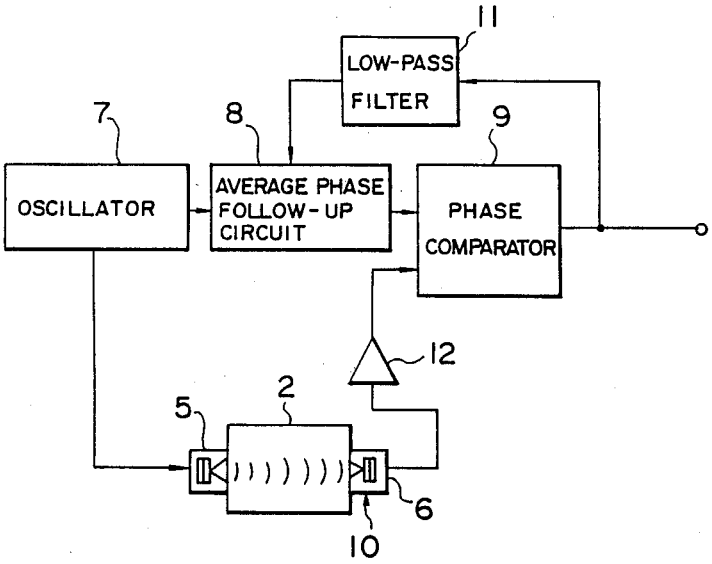
FIG. 41 PRIOR ART

A description will next be made of the fuel feed quantity control system according to the sixth embodiment of this invention, which is illustrated in FIG. 39 and as suited for use with an engine.

Although the correction of the output frequency of the air-flow sensor is limited to a certain low flow-rate range in the fifth embodiment described above, it has been expanded to the entire flow-rate range in the sixth embodiment. The system configuration diagram of the sixth embodiment is thus the same as that of the fifth embodiment (FIGS. 30 and 31) except for such a flow chart (the main program of the CPU 240) as shown in FIG. 39 which corresponds to FIG. 35.

The sixth embodiment will hereinafter described with reference to the flow chart shown in FIG. 39.

When a resetting signal is inputted to the CPU 240, the RAM 242, the RAM 242, the input and output ports, etc. are initialized in Step k1. In Steps k2–k5, the water temperature, intake air temperature, atmospheric pressure and battery voltages are A/D-converted respectively and are then stored at addresses WT, AT, AP and $V_B$ of the RAM 242.

In Step k6, a calculation of $30/T_R$ is performed based on the cycle of the crank angle sensor 27 to calculate the revolutionary speed $N_e$ of the engine.

In Step k7, a calculation of $AN \cdot T_R$ is performed on the basis of load datum AN and cycle $T_R$ which will be described subsequently, thereby calculating the average output frequency $F_a$ of the air-flow sensor 10.

In Step k8, linear interpolation is performed by a basic actuation time conversion factor map $f_1'$ set relative to the frequency $F_a$ as shown in Table 7 (which corresponds to Table 4 of the fifth embodiment), so that the basic actuation time conversion factor $K_p$ is calculated.

TABLE 6

| Map v' | | | | |
|---|---|---|---|---|
| Intake air temperature | $t_1$ | $t_2$ | $t_3$ | ... |
| Kinematic viscosity coefficient | $M_1$ | $M_2$ | $M_3$ | ... |

TABLE 7

| Map $f_1'$ | | | | |
|---|---|---|---|---|
| Air-flow sensor output, f | $F_{a1}$ | $F_{a2}$ | $F_{a3}$ | ... |
| Factor | $K_{p1}$ | $K_{p2}$ | $K_{p3}$ | ... |

TABLE 8

| Map h' | | | | |
|---|---|---|---|---|
| | $F_a$ | | | |
| $\nu$ | $F_{a1}$ | $F_{a2}$ | $F_{a3}$ | ... |
| $\nu_1$ | $K_{11}$ | $K_{12}$ | $K_{13}$ | ... |
| $\nu_2$ | $K_{21}$ | $K_{22}$ | $K_{23}$ | ... |
| $\nu_3$ | $K_{31}$ | $K_{32}$ | $K_{33}$ | ... |
| — | — | — | — | |
| — | — | — | — | |
| — | — | — | — | |
| — | — | — | — | |

The map $f_1'$ of Table 7 contains values obtained by multiplying with a constant the pulse constants $P_{cl}$ for the standard state of the intake air temperature of 23° C. and atmospheric pressure of 760 mmHg illustrated in FIG. 44.

The kinematic viscosity coefficient $\nu$ is calculated in Step k9. This kinematic viscosity coefficient $\nu$ is calculated by setting the $T_a$ -related term in Equation (8) in accordance with a coefficient-intake air temperature map such as that shown in Table 6 (which corresponds to Table 3 of the fifth embodiment) and then approximating the result in accordance with $v_{(AT)} \times C/BP$, where $v_{(AT)}$ is a factor obtained by interpolating the map v with the intake air temperature $T_a$, C is a constant and AP is a value obtained by subjecting the atmospheric pressure to A/D conversion.

In Step k10, the above basic actuation time conversion factor $K_p$ is corrected by a correction factor $h(F_a,\nu)$ which is determined by the intake air temperature and atmospheric pressure, namely, by operation parameters of the internal combustion engine, whereby changes in characteristics caused by a variation of the kinematic viscosity coefficient of the air-flow sensor 10 are corrected and stored as $K_p'$.

The factor $h(Fa,\nu)$ is a map h', in which factors $K_{ij}$ are set relative to output frequencies of the air-flow sensor 10 and kinematic viscosity coefficients as shown in Table 8 (which corresponds to Table 5 of the fifth embodiment). As the factors $K_{ij}$, ratios of the pulse constant $P_{cl}$ to the pulse constant $P_{c2}$ ($P_{c2}/P_{cl}$) shown in FIG. 44 may be set relative to the above coefficients $\nu_i$ and frequencies $F_{aj}$ for the intake air temperature of 60° C.

In Step k11, a correction factor is calculated for the water temperature datum WT from the map $f_2$ so as to correct the conversion factor $K_p'$. The thus corrected conversion factor is stored as an actuation time conversion factor $K_1$ in the RAM 242.

In Step k12, the data table $f_3$ stored beforehand in the ROM 241 is mapped on the basis of the battery voltage datum $V_B$ so as to calculate a dead time $T_D$, which is then stored in the RAM 242. After Step k12, the processing of Step k2 is performed again.

Incidentally, the sixth embodiment can perform an interrupt processing for the output signal of the air-flow sensor 10 in the same manner as the fifth embodiment (see FIG. 36). Another interrupt processing, which is performed upon occurrence of an interruption signal at the interruption input terminal P4 of the CPU 240 as a result of the output of a signal from the crank angle sensor 27, may also be performed by the sixth embodiment in much the same way as described above in connection with the fifth embodiment [see FIGS. 37(*a*) and 37(*b*)]. Description of these processings is therefore omitted herein.

The timing charts of FIGS. 38(*a*)–38(*d*), which are useful when the frequency division flag has been cleared, also apply to the sixth embodiment, and their description is omitted herein accordingly.

The sixth embodiment can therefore bring about substantially the same effects and advantages as the fifth embodiment described previously.

In the first–fourth embodiments, the correction range may also be expanded to the entire flow rate range without limiting same as described above. In such a variation, the system for opening or closing the switches 87,88 is no longer required in the first embodiment. In the second embodiment, Steps e6 and e11 become unnecessary in FIG. 14. In the third and fourth embodiments, it is necessary to set the correction factors $K_1,K_2,K_3;K_1^*,K_2^*$ for values applicable to the entire range of flow rates.

In each of the above-described embodiments, the fuel feed quantity may be corrected by performing correction of variations of the volumetric flow rate, which variations are caused by variations in kinematic viscosity of the atmospheric air, in accordance with either one of the intake air temperature $T_a$ and atmospheric pressure $P_a$ information and the information on the output frequency of the air-flow sensor 10.

When the correction is performed based on the intake air temperature alone for instance, the column of kinematic viscosity coefficients $\nu$ should be replaced by intake air temperatures AT in the maps h,h'.

Further, the range in which corrections are performed in accordance with the intake air temperature and atmospheric pressure may be limited based on the revolutionary speed of the engine or A/N in each of the above-described embodiments.

Instead of counting pulses outputted from the air-flow sensor 10 between adjacent rises of the crank angle sensor 27, pulses outputted between adjacent falls may be counted. As a further alternative, pulses outputted from the air-flow sensor 10 over several cycles of the crank angle sensor 27 may also be counted.

In addition, instead of counting pulses outputted from the air-flow sensor 10, counting may be performed on pulses obtained respectively by multiplying output pulses of the air-flow sensor 10 with a constant corresponding to the output frequency of the air-flow sensor 10. In the above-described embodiments, the crank angle sensor 27 is used for the detection of the crank angle. Similar effects may however be attained by using the ignition signal of the internal combustion engine 13 instead of relying upon the crank angle sensor 27.

We claim:

1. A fuel feed quantity control system for an internal combustion engine, comprising:

a Karman vortex air-flow sensor arranged in a intake passage of the engine;

at least one injector for feeding a fuel into the engine;

a means for controlling the quantity of the fuel, which is to be injected from the injector, on the basis of intake air flow rate information from the air-flow sensor;

a means for detecting at least one operation parameter of the engine;

a means for correcting the quantity of the fuel, which is to be fed into the engine, in accordance with said at least one operation parameter from said operation parameter detecting means and frequency information outputted from the air-flow sensor;

whereby the quantity of the fuel, which has been determined based on an output from the air-flow sensor, is corrected by the fuel feed quantity correcting means in accordance with a change in kinematic viscosity of the atmospheric air; and wherein said fuel feed quantity correcting means performs the correction of the quantity of the fuel, which is to be fed, in accordance with said at least one operation parameter from said operation parameter detecting means and said frequency information outputted from the air-flow sensor, in a range of frequencies which are outputted from the air-flow sensor and are smaller than a predetermined value.

2. A fuel feed quantity control system for an internal combustion engine, comprising:

a Karman vortex air-flow sensor arranged in an intake passage of the engine;

at least one injector for feeding a fuel into the engine;

a means for controlling the quantity of the fuel, which is to be injected from the injector, on the basis of intake air flow rate information from the air-flow sensor;

a means for detecting at least one operation parameter of the engine;

a means for correcting the quantity of the fuel, which is to be fed into the engine, in accordance with said at least one operation parameter from said operation parameter detecting means and frequency information outputted from the air-flow sensor;

whereby the quantity of the fuel, which has been determined based on an output from the air-flow sensor, is corrected by the fuel feed quantity correcting means in accordance with a change in kinematic viscosity of the atmospheric air; and wherein said fuel feed quantity correcting means is constructed as a frequency correction circuit for directly converting and correcting the frequency of a waveform outputted from the air-flow sensor, and the frequency correcting means comprises a Karman cycle measuring circuit for measuring the cycle of an output of the air-flow sensor, a Karman cycle correcting circuit for correcting information on the cycle, which has been measured by the karman cycle measuring circuit, on the basis of said at least one operation parameter, and a Karman frequency output circuit for converting cycle information of the Karman cycle correcting circuit into frequency information.

3. A fuel feed quantity control system for an internal combustion engine, comprising:

a Karman vortex air-flow sensor arranged in an intake passage of the engine;

at least one injector for feeding a fuel into the engine;

a means for controlling the quantity of the fuel, which is to be injected from the injector, on the basis of intake air flow rate information form the air-flow sensor;

a means for detecting at least one operation parameter of the engine;

a means for correcting the quantity of the fuel, which is to be fed into the engine, in accordance with said at least one operation parameter from said operation parameter detecting means and frequency information outputted from the air-flow sensor;

whereby the quantity of the fuel, which has been determined based on an output from the air-flow sensor, is corrected by the fuel feed quantity correcting means in accordance with a change in kinetic viscosity of the atmospheric air; and wherein the fuel feed quantity control means is equipped with a means for computing a basic injection time period for the injector on the basis of a pulse constant defined as a flow rate per pulse outputted from the air-flow sensor, and said fuel feed quantity correcting means is provided with a means for changing a correction factor, which is to be multiplied with the basic injection time period, on the basis of said at least one operation parameter and the frequency information outputted from the air-flow sensor.

4. The system as claimed in claim 3, wherein said correction factor changing means is a memory means for storing the mutual relationship among the operation parameter, the frequency information outputted from the air-flow sensor and the correction factor.

5. A fuel feed quantity control system for an internal combustion engine, comprising:

a karman vortex air-flow sensor arranged in an intake passage of the engine;

at least one injector for feeding a fuel into the engine;

a means for controlling the quantity of the fuel, which is to be injected from the injector, on the basis of intake air flow rate information from the air-flow sensor;

a means for detecting at least one operation parameter of the engine;

a means for correcting the quantity of the fuel, which is to be fed into the engine, in accordance with said at least one operation parameter from said operation parameter detecting means and frequency information outputted from the air-flow sensor;

whereby the quantity of the fuel, which has been determined based on an output from the air-flow sensor, is corrected by the fuel feed quantity correcting means in accordance with a change in kinematic viscosity of the atmospheric air; and wherein said fuel feed quantity control means is equipped with a means for computing an injection time period for the injector on the basis of a pulse constant defined as a flow rate per pulse outputted form the air-flow sensor, and said fuel feed quantity correcting means is provided with a means for changing the pulse constant on the basis of said at least one operation parameter so as to perform the correction of the quantity of the fuel.

6. The system as claimed in claim 5, wherein said at least one operation parameter is the intake air temperature.

7. The system as claimed in claim 5, wherein said at least one operation parameter is the atmospheric pressure.

8. The system as claimed in claim 5, wherein said fuel feed quantity control means comprises:

a means for computing the quantity of the fuel, which is to be fed into the engine, on the basis of respective outputs from the air-flow sensor, a crank angle sensor for detecting the crank angle of the engine and said fuel feed quantity correcting means; and a means for actuating the injector on the basis of an output from said computing means.

* * * * *